US012650051B2

(12) United States Patent
Rankin et al.

(10) Patent No.: US 12,650,051 B2
(45) Date of Patent: Jun. 9, 2026

(54) SUBSEA COMPLETION SYSTEMS

(71) Applicant: Chevron U.S.A. Inc., San Ramon, CA (US)

(72) Inventors: John Lloyd Rankin, Kingwood, TX (US); Thomas Gary Corbett, Willis, TX (US); Matthew Ryan Ischy, Richmond, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 19/072,583

(22) Filed: Mar. 6, 2025

(65) Prior Publication Data

US 2025/0283385 A1 Sep. 11, 2025

Related U.S. Application Data

(60) Provisional application No. 63/562,497, filed on Mar. 7, 2024.

(51) Int. Cl.
*E21B 33/035* (2006.01)

(52) U.S. Cl.
CPC ..... *E21B 33/035* (2013.01)

(58) Field of Classification Search
CPC ..... E21B 33/035
See application file for complete search history.

(56) References Cited

U.S. PATENT DOCUMENTS

2005/0028980 A1* 2/2005 Page ..... E21B 33/0353 166/373
2013/0075109 A1* 3/2013 Frisby ..... E21B 43/128 166/373
2014/0008085 A1* 1/2014 Tinnen ..... E21B 33/134 166/134
2022/0034216 A1* 2/2022 Abalkhail ..... E21B 47/00

FOREIGN PATENT DOCUMENTS

WO WO-2015054020 A1 * 4/2015 ..... E21B 33/035

* cited by examiner

*Primary Examiner* — James G Sayre
(74) *Attorney, Agent, or Firm* — Smith & Woldesenbet Law Group, PLLC

(57) ABSTRACT

A subsea completion system can include a lower completion assembly (LCA) having a receptacle disposed at a top end of the LCA, where the LCA comprises a LCA wall that forms a LCA cavity; a first barrier disposed within the LCA cavity, where the first barrier forms a first fluidic seal with the LCA wall, and where the first barrier is configured to open when a first differential force within the LCA cavity reaches a first threshold value; an upper completion assembly (UCA) having a tubing string that includes a tubing string wall that forms a tubing string cavity; and a second barrier disposed within the tubing string cavity, where the second barrier forms a second fluidic seal with the tubing string wall, and where the second barrier is configured to open when a second differential force within the tubing string cavity reaches a second threshold value.

20 Claims, 14 Drawing Sheets

SUBSEA COMPLETION SYSTEMS

CROSS-REFERENCE TO RELATED APPLICATIONS

This application claims priority to U.S. Provisional Patent Application Ser. No. 63/562,497 titled "Subsea Completion Systems" and filed on Mar. 7, 2024, the entire contents of which are hereby incorporated herein by reference.

TECHNICAL FIELD

The present application is related to subsea field operations and, more particularly, to subsea completion systems.

BACKGROUND

During subsea completions using a horizontal Xmas tree system, the final step of installing barriers into the well is to use slickline to install crown plugs in the tubing hanger. This process can take 3 to 5 days of around-the-clock operation, cost large amounts of money in equipment rental, and pose a number of significant safety concerns. For example, in order to install crown plugs in the tubing hanger, an operator would need to rig up a compensated coiled tubing lift frame (CCTLF), rig up a surface flow tree (SFT) tool, rig up a slickline, run the slickline to retrieve the isolation sleeve, install the crown plugs, rig down the slickline, rig down the SFT, and rig down the CCTLF.

In the current art, running crown plugs in place cannot be done because there is no way to prevent wellbore packer fluid from entering the tubing string on installation. Packer fluid is damaging to the formation, and there is no way to properly circulate fluids to eliminate packer fluid from being interfaced with the well. In addition, running crown plugs in place cannot be done because the production bore of the tubing hanger is open (not sealed over). If the well begins to flow prior to the tubing hanger engaging the Xmas tree, there is no way to shut in the BOP and stop the flow without damaging the completion as the open port and tubing would provide a conduit out of the well above the BOP.

SUMMARY

In general, in one aspect, the disclosure relates to a subsea completion system that includes a lower completion assembly (LCA) having a receptacle disposed at a top end of the LCA, where the LCA includes a LCA wall that forms a LCA cavity. The subsea completion system may also include a first barrier disposed within the LCA cavity, where the first barrier forms a first fluidic seal with the LCA wall, and where the first barrier is configured to open the first fluidic seal when a first differential force applied to the first barrier within the LCA cavity reaches a first threshold value. The subsea completion system may further include an upper completion assembly (UCA) having a tubing string disposed toward a bottom end of the UCA, where the tubing string includes a tubing string wall that forms a tubing string cavity. The subsea completion system may also include a second barrier disposed within the tubing string cavity, where the second barrier forms a second fluidic seal with the tubing string wall, and where the second barrier is configured to open the second fluidic seal when a second differential force applied to the second barrier within the tubing string cavity reaches a second threshold value.

In another aspect, the disclosure relates to a method of establishing a subsea completion system. The method can include inserting a first barrier within a top end of a lower completion assembly (LCA) cavity formed by a LCA wall of the LCA, where first barrier forms a first fluidic seal with the LCA wall, where the first barrier is configured to open the first fluidic seal when a first differential force applied to the first barrier within the LCA cavity reaches a first threshold value, and where the LCA with the first barrier is configured to be subsequently inserted into a casing string. The method can also include inserting a second barrier toward a bottom end of a tubing string of an upper completion assembly (UCA), where the tubing string has a tubing string cavity formed by a tubing string wall, where the second barrier forms a second fluidic seal with the tubing string wall, where the second barrier is configured to open the second fluidic seal when a second differential force applied to the second barrier within the tubing string cavity reaches a second threshold value, and where the UCA with the second barrier is configured to be inserted into the casing string after the LCA is inserted into the casing string.

In yet another aspect, the disclosure relates to a method of implementing a subsea completion system. The method can include inserting a lower completion assembly (LCA) into a casing string for a subsea wellbore, where the LCA includes a receptacle disposed toward its top end and has a LCA wall that forms a LCA cavity, where the LCA cavity has disposed therein toward its top end a first barrier, where first barrier forms a first substantial fluidic seal with the LCA wall, where the first barrier is configured to open the first substantial fluidic seal when a first differential force applied to the first barrier within the LCA cavity reaches a first threshold value, and where the LCA below the first barrier is filled with a working fluid. The method can also include filling the casing string with a packer fluid. The method can further include inserting an upper completion assembly (UCA) into the casing string, where the UCA includes a tubing string having a tubing string wall that forms a tubing string cavity, where the tubing string cavity has disposed therein toward its bottom end a second barrier, where the second barrier forms a second substantial fluidic seal with the tubing string wall, where the second barrier is configured to open the second substantial fluidic seal when a second differential force applied to the second barrier within the tubing string cavity reaches a second threshold value, and where the UCA above the second barrier is filled with the working fluid. The method can also include engaging the bottom end of the UCA with the top end of the receptacle of the LCA. The method can further include activating a working fluid control system. The method can also include installing a crown plug.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

Figure 1:
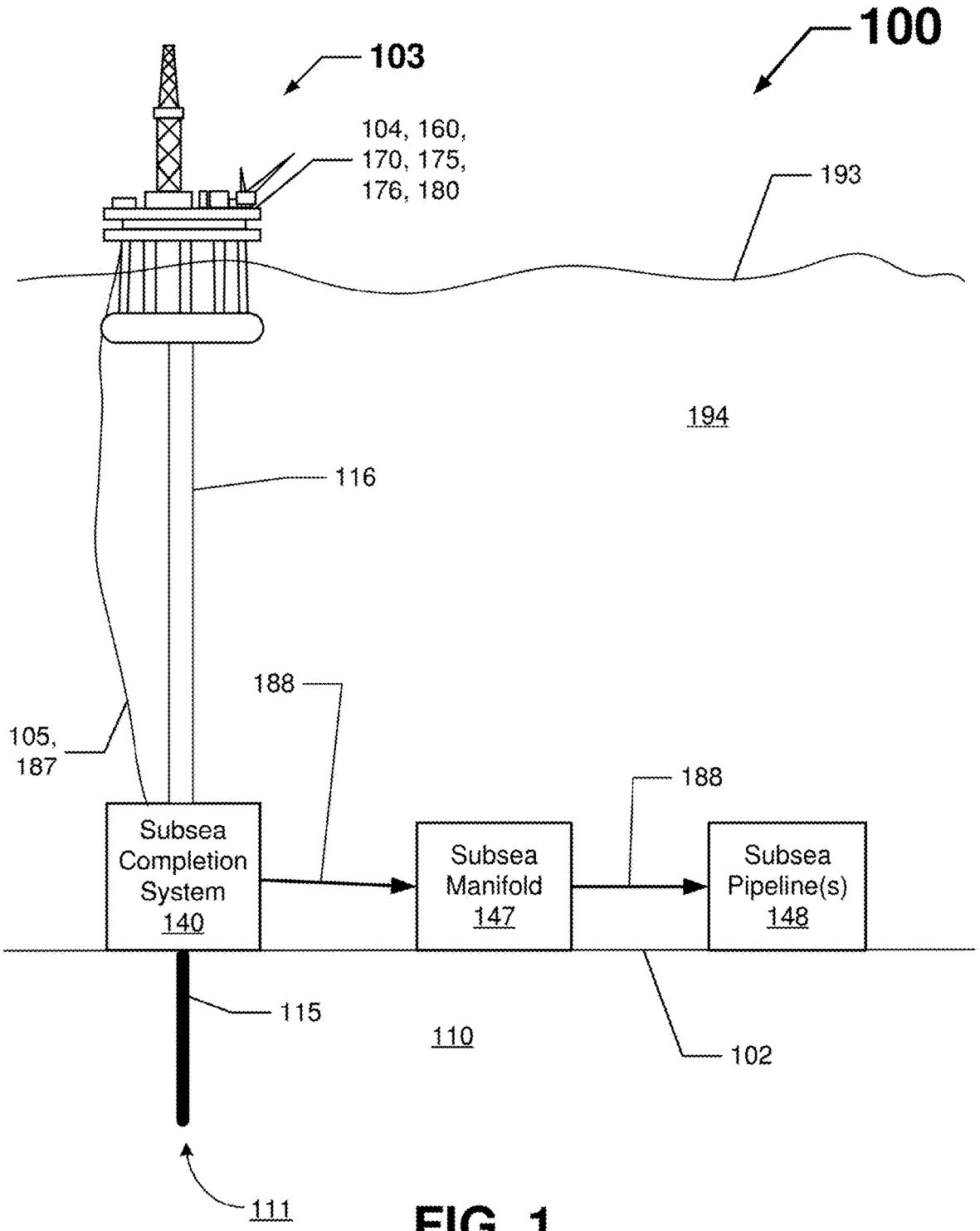
FIG. 1 shows a field system that includes a subsea completion system according to certain example embodiments.

The example embodiments discussed herein are directed to systems, apparatus, methods, and devices for subsea completion systems. Example embodiments can be used in subsea completion systems for subterranean field operations (e.g., injection operations, production operations). Example embodiments can be used for subsea completion systems in offshore subterranean operations. While example embodiments are described as being used in conjunction with horizontal Xmas trees herein, example embodiments can be used in conjunction with other components and/or configurations of subsea completion systems.

Example subsea completion systems can include one or multiple components, where a component can be made from a single piece (as from a mold or an extrusion or a three-dimensional printing process). When a component (or portion thereof) of an example subsea completion system is made from a single piece, the single piece can be cut out, bent, stamped, and/or otherwise shaped to create certain features, elements, or other portions of the component. Alternatively, a component (or portion thereof) of an example subsea completion system can be made from multiple pieces that are mechanically coupled to each other. In such a case, the multiple pieces can be mechanically coupled to each other using one or more of a number of coupling methods, including but not limited to adhesives, welding, fastening devices, compression fittings, mating threads, and slotted fittings. One or more pieces that are mechanically coupled to each other can be coupled to each other in one or more of a number of ways, including but not limited to fixedly, hingedly, rotatably, removably, slidably, and threadably.

Example subsea completion systems can be designed to comply with certain standards and/or requirements. Examples of entities that set such standards and/or requirements can include, but are not limited to, the Society of Petroleum Engineers, the American Petroleum Institute (API), the International Standards Organization (ISO), and the Occupational Safety and Health Administration (OSHA). Each component of a subsea completion system (including portions thereof) can be made of one or more of a number of suitable materials, including but not limited to metal (e.g., stainless steel), ceramic, rubber, glass, fibrous material, and plastic.

The use of the terms "about", "approximately", and similar terms applies to all numeric values, whether or not explicitly indicated. These terms generally refer to a range of numbers that one of ordinary skill in the art would consider as a reasonable amount of deviation to the recited numeric values (i.e., having the equivalent function or result). For example, this term may be construed as including a deviation of +10 percent of the given numeric value provided such a deviation does not alter the end function or result of the value. Therefore, a value of about 1% may be construed to be a range from 0.9% to 1.1%. Furthermore, a range may be construed to include the start and the end of the range. For example, a range of 10% to 20% (i.e., range of 10%-20%) includes 10% and also includes 20%, and includes percentages in between 10% and 20%, unless explicitly stated otherwise herein. Similarly, a range of between 10% and 20% (i.e., range between 10%-20%) includes 10% and also includes 20%, and includes percentages in between 10% and 20%, unless explicitly stated otherwise herein.

A "subterranean formation" refers to practically any volume under a surface. For example, it may be practically any volume under a terrestrial surface (e.g., a land surface), practically any volume under a seafloor, etc. Each subsurface volume of interest may have a variety of characteristics, such as petrophysical rock properties, reservoir fluid properties, reservoir conditions, hydrocarbon properties, or any combination thereof. For example, each subsurface volume of interest may be associated with one or more of: temperature, porosity, salinity, permeability, water composition, mineralogy, hydrocarbon type, hydrocarbon quantity, reservoir location, pressure, etc. Those of ordinary skill in the art will appreciate that the characteristics are many, including, but not limited to: shale gas, shale oil, tight gas, tight oil, tight carbonate, carbonate, vuggy carbonate, sandstone, unconventional (e.g., a permeability of less than 25 millidarcy (mD) such as a permeability of from 0.000001 mD to 25 mD)), diatomite, geothermal, mineral, etc. The terms "formation", "subsurface formation", "hydrocarbon-bearing formation", "reservoir", "subsurface reservoir", "subsurface area of interest", "subsurface region of interest", "subsurface volume of interest", and the like may be used synonymously. The term "subterranean formation" is not limited to any description or configuration described herein.

A "well" or a "wellbore" refers to a single hole, usually cylindrical, that is drilled into a subsurface volume of interest. A well or a wellbore may be drilled in one or more directions. For example, a well or a wellbore may include a vertical well, a horizontal well, a deviated well, and/or other type of well. A well or a wellbore may be drilled in the subterranean formation for exploration and/or recovery of resources. A plurality of wells (e.g., tens to hundreds of wells) or a plurality of wellbores are often used in a field depending on the desired outcome.

A well or a wellbore may be drilled into a subsurface volume of interest using practically any drilling technique and equipment known in the art, such as geosteering, directional drilling, etc. Drilling the well may include using a tool, such as a drilling tool that includes a drill bit and a drill string. Drilling fluid, such as drilling mud, may be used while drilling in order to cool the drill tool and remove cuttings. Other tools may also be used while drilling or after drilling, such as measurement-while-drilling (MWD) tools, seismic-while-drilling tools, wireline tools, logging-while-drilling (LWD) tools, or other downhole tools. After drilling to a predetermined depth, the drill string and the drill bit may be removed, and then the casing, the tubing, and/or other equipment may be installed according to the design of the well. The equipment to be used in drilling the well may be dependent on the design of the well, the subterranean formation, the hydrocarbons, and/or other factors.

A well may include a plurality of components, such as, but not limited to, a casing, a liner, a tubing string, a sensor, a packer, a screen, a gravel pack, artificial lift equipment (e.g., an electric submersible pump (ESP)), and/or other components. If a well is drilled offshore, the well may include one or more of the previous components plus other offshore components, such as a riser. A well may also include equipment to control fluid flow into the well, control fluid flow out of the well, or any combination thereof. For example, a well may include a wellhead, a choke, a valve, and/or other control devices. These control devices may be located on the surface, in the subsurface (e.g., downhole in the well), or any combination thereof. In some embodiments, the same control devices may be used to control fluid flow into and out of the well.

In some embodiments, different devices (e.g., barriers as discussed below) may be used to control fluid flow into and out of a well. In some embodiments, the rate of flow of fluids through the well may depend on the fluid handling capacities of the surface facility that is in fluidic communication with the well. The equipment to be used in controlling fluid flow into and out of a well may be dependent on the well, the subsurface region, the surface facility, and/or other factors. Moreover, sand control equipment and/or sand monitoring equipment may also be installed (e.g., downhole and/or on the surface). A well may also include any completion hardware that is not discussed separately. The term "well" may be used synonymously with the terms "borehole," "wellbore," or "well bore." The term "well" is not limited to any description or configuration described herein.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A.

In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C.

In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C).

In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number or a four-digit number, and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of subsea completion systems will be described more fully hereinafter with reference to the accompanying drawings, in which example embodiments of subsea completion systems are shown. Subsea completion systems may, however, be embodied in many different forms and should not be construed as limited to the example embodiments set forth herein. Rather, these example embodiments are provided so that this disclosure will be thorough and complete, and will fully convey the scope of subsea completion systems to those of ordinary skill in the art. Like, but not necessarily the same, elements (also sometimes called components) in the various figures are denoted by like reference numerals for consistency.

Terms such as "first", "second", "outer", "inner", "top", "bottom", "above", "below", "distal", "proximal", "front,", "rear," "left," "right," "on", and "within", when present, are used merely to distinguish one component (or part of a component or state of a component) from another. This list of terms is not exclusive. Such terms are not meant to denote a preference or a particular orientation, and they are not meant to limit embodiments of subsea completion systems. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 2:
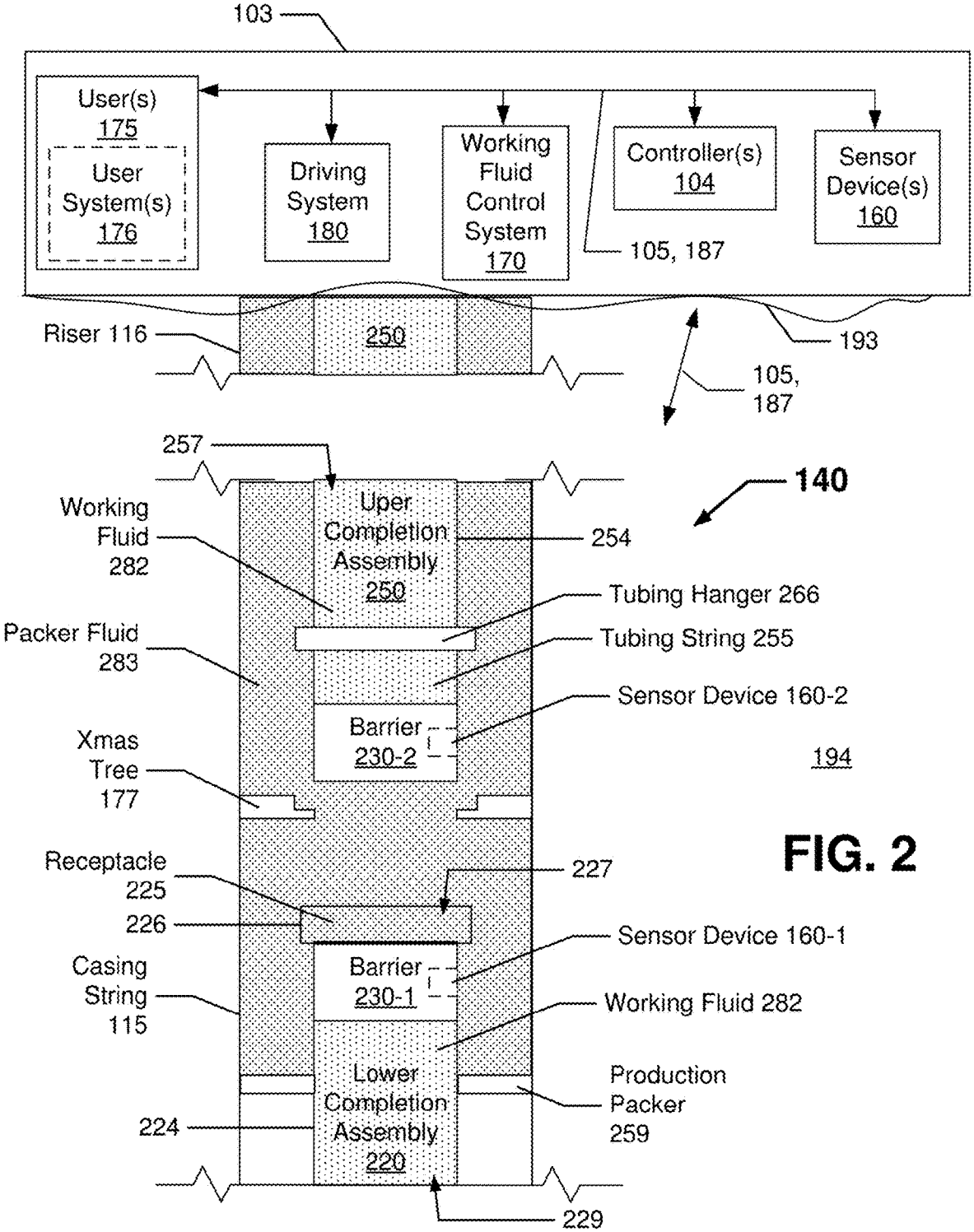
FIG. 2 shows details of the floating platform and the subsea completion system of the field system of FIG. 1 according to certain example embodiments.

FIG. 1 shows a field system 100 that includes a subsea completion system 140 according to certain example embodiments. FIG. 2 shows details of the floating structure 103 and the subsea completion system 140 of the field system 100 of FIG. 1 according to certain example embodiments. The field system 100 includes multiple components. For example, as shown in FIG. 1, in addition to the subsea completion system 140 located in the water 194 at or near the seabed 102, the field system 100 can include a wellbore 111 in a subterranean formation 110, a floating structure 103 that floats in the water 194 at a waterline 193, one or more controllers 104 located on the floating structure 103, one or more sensor devices 160, a working fluid control system 170 located on the floating structure 103, and one or more users 175, which can each include one or more user systems 176, a driving system 180 located on the floating structure 103, a subsea manifold 147 located at or near the seabed 102, one or more pipelines 148 located at or near the seabed 102, and other piping 188 located at or near the seabed 102. The wellbore 111 is bounded around its outer perimeter by a casing string 115.

The components shown in the field system 100 of FIGS. 1 and 2 are not exhaustive, and in some embodiments, one or more of the components shown in FIGS. 1 and 2 may not be included in the field system 100 in which example embodiments may be used. Any component of the field system 100 can be discrete or combined with one or more other components of the subsea completion system 140. Also, one or more components of the field system 100 can have different configurations. Similarly, one or more of the components shown in FIGS. 1 and 2 may not be included in the subsea completion system 140 in which example embodiments may be used. Any component of the subsea completion system 140 can be discrete or combined with one or more other components of the subsea completion system 140. Also, one or more components of the subsea completion system 140 can have different configurations.

The wellbore 111 has a casing string 115 (e.g., production casing), inside of which is positioned a tubing string. The tubing string has a cavity that extends continuously along its length, and there is an annulus between the tubing string and the casing string 115 that extends continuously along the length of the tubing string. The wellbore 111 may have any depth (e.g., thousands of feet, tens of thousands of feet). The diameter of the wellbore 111 (and so also the diameter of the casing string 115) may decrease in stepwise increments along its length, starting with the largest diameter (e.g., 36 inches, 22 inches) at the seabed 102 and ending with the smallest diameter (e.g., 12 inches, 6 inches) at the distal end of the wellbore 111. The wellbore 111 may have one or more vertical segments and/or one or more horizontal segments along its length. The true vertical depth (TVD) of the wellbore 111 may be less than the overall length of the wellbore 111.

The floating structure 103 in this case is used for subterranean field operations (also called subsea field operations herein), in which exploration and production phases (also called stages) of the subsea field operation are executed to extract one or more subterranean resources (e.g., oil, natural gas, water, hydrogen gas) from and/or inject resources (e.g., carbon monoxide, carbon dioxide, water) into the subterranean formation 110 via the wellbore 111. In some cases, as when the depth of the water 194 between the waterline 193 and the seabed 102 is relatively small (e.g., hundreds of feet), the structure 103 (e.g., in the form of a jack-up rig) may be mounted on the seabed 102.

In alternative embodiments, as when a subsea operation is close to land, the structure 103 may be land-based rather than floating or otherwise in the water 194. In addition, or in the alternative, a field operation involves multiple wellbores 111 that originate from the same proximate location (sometimes called a pad) on the seabed 102. In such cases, the wellbores 111 are drilled and completed one at a time. Also, in such cases, there may be one subsea completion system 140 for each wellbore 111. To extract a subterranean resource from a wellbore 111 on production and/or to inject a subterranean resource into the subterranean formation 110 through the wellbore 111, the subsea completion system 140 is disposed toward the top of the wellbore 111 at the seabed 102.

The subsea completion system 140 of the field system 100 may include or be an assembly (or multiple assemblies) of one or more of a number of components. For example, components of the subsea completion system 140 can include, but are not limited to, an upper wellhead, a tubing hanger 266, a tubing spool, one or more valves, tubing pipes (part of a tubing string), a receptacle, one or more barriers 230 (discussed below), one or more valves, one or more sensor devices 160, piping (e.g., piping 188), a casing spool, and a casing hanger. Some of the components of the subsea completion system 140 may be grouped into their own assembly within the subsea completion system 140.

For example, the subsea completion system 140 shown FIG. 2 includes an upper completion assembly 250, a lower completion assembly 220, and a subsea Xmas tree 177 located within part of the casing string 115. The subsea Xmas tree 177 is a stack of vertical and/or horizontal valves, spools, pressure gauges, chokes, and/or other components installed as an assembly on a subsea wellhead. The subsea Xmas tree 177 may be configured to provide a controllable interface between the wellbore 111 and production facilities (e.g., via the subsea pipeline 148). The various valves of the subsea Xmas tree 177 may be used for such purposes as testing, servicing, regulating, and/or choking the stream of produced subterranean resources coming up from the wellbore 111 and/or flowing down into the wellbore 111. In certain example embodiments, the subsea Xmas tree 177 of the subsea completion system 140 is a horizontal tree. The subsea Xmas tree 177 may include a receiving feature that is configured to receive a tubing hanger 266, which is integrated with the upper completion assembly 250.

The lower completion assembly 220 (LCA 220) of the subsea completion system 140 in this case includes a receptacle 225 disposed at a top end of the LCA 220. The receptacle 225 has a receptacle wall 226 that forms a receptacle cavity 227 that runs along the height of the receptacle 225. The receptacle 225 may take any of a number of forms. For example, the receptacle 225 may be or include a polished bore receptacle (PBR). The diameter of the receptacle wall 226 may be larger than the diameter (defined by a wall 224) of the rest of the LCA 220 and larger than the diameter (defined by a wall 254) of the tubing string 255 of the UCA 250.

Depending on the location of the barrier 230-1, the cavity 227 may continue downward beyond the receptacle 225 into part of the LCA 220 up to the barrier 230-1. Below the barrier 230-1, there is a continuous cavity 229 throughout the remainder of the LCA 220. The remainder of the LCA 220 below the receptacle 225 may be or include a tubing string, which is made up of multiple tubing pipes that are coupled directly or indirectly to each other end to end in series (e.g., substantially similar to the tubing string 255 of the UCA 250). Most of the tubing string of the LCA 220 may be positioned within the wellbore 111 in the subterranean formation 110.

The LCA 220 of the subsea completion system 140 in this case also includes a barrier 230-1. The barrier 230-1 of the LCA 220 is configured to be positioned within the cavity 229 of the LCA 220 and/or the cavity 227 of the receptacle 225. The barrier 230-1 forms a fluidic seal with the adjacent wall 224 of the LCA 220 (which may include the wall 226 of the receptacle 225). In this way, the barrier 230-1 prevents the packer fluid 283 disposed between the LCA 220 and the casing string 115 from entering the LCA cavity 229 and, in some cases, some or all of the receptacle cavity 227, when the barrier 230-1 forms a fluidic seal with the LCA wall 224 and/or the receptacle wall 226. In this example, the barrier 230-1 also seals working fluid 282 within the LCA cavity 229 (which may include some of the receptacle cavity 227) below the barrier 230-1 when the barrier 230-1 forms a fluidic seal with the LCA wall 224.

The barrier 230-1 of the LCA 220 is not designed to be permanent. Specifically, the barrier 230-1 is designed to open (e.g., break) the fluidic seal with the wall 224 of the LCA 220 (which may include the wall 226 of the receptacle 225) under certain conditions. In some cases, the barrier 230-1 may be configured in such a way that allows a user 175 to set the conditions under which the barrier 230-1 open (e.g., breaks) the fluidic seal with the wall 224 of the LCA 220 (which may include the wall 226 of the receptacle 225). In other cases, the conditions under which the barrier 230-1 opens (e.g., breaks) the fluidic seal with the wall 224 of the LCA 220 (which may include the wall 226 of the receptacle 225) are set by the manufacturer of the barrier 230-1.

As an example, the barrier 230-1 may be designed to open (e.g., break) the fluidic seal with the wall 224 of the LCA 220 (which may include the wall 226 of the receptacle 225) when the differential force applied to the barrier 230-1 within the cavity 227 of the receptacle 225 and/or the cavity 229 of the remainder of the LCA 220 reaches a threshold value (e.g., 3000 psi, 6000 psi, 15000 psi). In other words, in such a configuration, the barrier 230-1 opens (e.g., breaks) the fluidic seal with the wall 224 of the LCA 220 (which may include the wall 226 of the receptacle 225) when the difference in pressure within the cavity 227 and/or the cavity 229 on one side of the barrier 230-1 relative to the pressure within the cavity 227 and/or the cavity 229 on the other side of the barrier 230-1 exceeds the threshold value. In this case, the fluidic seal created between the barrier 230-1 and the wall 224 of the LCA 220 (which may include the wall 226 of the receptacle 225) isolates a working fluid 282 within the cavity 227 and/or the cavity 229 below the barrier 230-1 and a packer fluid 283 above the barrier 230-1 and outside the wall 224 of the LCA 220 (which may include the wall 226 of the receptacle 225) within the casing string 115.

The barrier 230-1 may be positioned at any point within the cavity 227 of the receptacle and/or the cavity 229 of the LCA 220. In certain example embodiments, the barrier 230-1 is positioned within the cavity 227 and/or the cavity 229 toward the top end (e.g., within the receptacle 225, just below the receptacle 225) of the LCA 220. In some cases, when the barrier 230-1 opens (e.g., breaks) the fluidic seal with the wall 224 of the LCA 220 (which may include the wall 226 of the receptacle 225), the barrier 230-1 may break apart into a number of small pieces that are not retrievable. The barrier 230-1 may take one or more of a number of forms. For example, the barrier 230-1 may be or include a disc (e.g., made of glass, made of ceramics). As another example, the barrier 230-1 may be or include a valve (e.g., a multi-stage ball valve). An example of a barrier 230-1 is shown below with respect to FIG. 7.

The upper completion assembly 250 (UCA 250) of the subsea completion system 140 in this case includes a tubing string 255 that is or includes multiple tubing pipes that are coupled directly or indirectly to each other end to end in series. Depending on the location of the barrier 230-2, some of the tubing string 255 may be disposed below the barrier 230-2 at the bottom end of the UCA 250, while the remainder (the majority) of the tubing string 255 is disposed above the barrier 230-2. The tubing string 255 has a tubing string wall 254 that forms a tubing string cavity 257 that runs along all or most of the height of the tubing string 255. The diameter of the tubing string wall 254 may be smaller than the diameter formed by the receptacle wall 226 of the receptacle 225 of the LCA 220. The cavity 257 originates at or near the floating structure 103 and continues downward to the barrier 230-2. Most of the tubing string 255 of the UCA 250 is positioned inside the riser 116. The UCA 250 also includes a tubing hanger 266 in this case.

The UCA 250 of the subsea completion system 140 in this case also includes a barrier 230-2. The barrier 230-2 of the UCA 250 is configured to be positioned within the cavity 257 of the UCA 250 and forms a fluidic seal with the adjacent wall 254 of the UCA 250. In this way, the barrier 230-2 prevents the packer fluid 283 disposed between the UCA 250 and the casing string 115 from entering the tubing string cavity 257 when the barrier 230-2 forms a fluidic seal with the tubing string wall 254. In this example, the barrier 230-2 also seals the working fluid 282 within the tubing string cavity 257 above the barrier 230-2 when the barrier 230-2 forms a fluidic seal with the tubing string wall 254.

The barrier 230-2 of the UCA 250 is not designed to be permanent. Specifically, the barrier 230-2 is designed to open (e.g., break) the fluidic seal with the wall 254 of the UCA 250 under certain conditions. In some cases, the barrier 230-2 may be configured in such a way that allows a user 175 to set the conditions under which the barrier 230-2 opens (e.g., breaks) the fluidic seal with the wall 254 of the UCA 250. In other cases, the conditions under which the barrier 230-2 opens (e.g., breaks) the fluidic seal with the wall 254 of the UCA 250 are set by the manufacturer of the barrier 230-2.

As an example, the barrier 230-2 may be designed to open (e.g., break) the fluidic seal with the wall 254 of the UCA 250 when the differential force applied to the barrier 230-2 within the cavity 257 of the UCA 250 reaches a threshold value (e.g., 1500 psi, 3000 psi, 10000 psi). In other words, in such a configuration, the barrier 230-2 opens (e.g., breaks) the fluidic seal with the wall 254 of the UCA 250 when the difference in pressure within the cavity 257 on one side of the barrier 230-2 relative to the pressure within the cavity 257 on the other side of the barrier 230-2 exceeds the threshold value. In this case, the fluidic seal created between the barrier 230-2 and the wall 254 of the UCA 250 isolates a working fluid 282 within the cavity 257 above the barrier 230-2 and the packer fluid 283 below the barrier 230-2 and outside the wall 254 of the UCA 250 within the casing string 115.

The barrier 230-2 may be positioned at any point within the cavity 257 of the UCA 250. In certain example embodiments, the barrier 230-2 is positioned within the cavity 257 toward the bottom end (e.g., within the distal most tubing pipe of the tubing string 255) of the UCA 250. In some cases, when the barrier 230-2 opens (e.g., breaks) the fluidic seal with the wall 254 of the UCA 250, the barrier 230-2 may break apart into a number of small pieces that are not retrievable. The barrier 230-2 may take one or more of a number of forms. For example, the barrier 230-2 may be or include a disc (e.g., made of glass, made of ceramics). As another example, the barrier 230-2 may be or include a valve (e.g., a multi-stage ball valve). As discussed above, an example of a barrier 230-2 is shown below with respect to FIG. 7.

When the subsea completion system 140 includes the barrier 230-1 and the barrier 230-2, at least one characteristic (e.g., threshold value, material, size, configuration, configurability) of the barrier 230-1 of the LCA 220 may differ from the corresponding characteristic of the barrier 230-2 of the UCA 250. For example, the threshold value of the barrier 230-1 may be more than or less than the threshold value of the barrier 230-2. As another example, the barrier 230-1 of the LCA 220 may be or include a ball valve, while the barrier 230-2 of the UCA 250 may be or include a glass disc.

Also positioned within the casing string 115 in FIG. 2 is a production packer 259, which is generally a short hollow cylinder. The production packer 259 abuts against the inner surface of the wall of the casing string 115 along its outer perimeter, and the production packer 259 abuts against the outer surface of the LCA wall 224 along its inner perimeter. Under this configuration, the production packer 259 creates a fluidic seal with the wall 224 of the LCA 220 and with the casing string 115. As a result, the packer fluid 283 remains above the production packer 259 within the casing string 115, and none of the packer fluid 283 is below the production packer 259 within the casing string 115.

Additional piping 188 may be used to transfer a subterranean resource between the subsea completion system 140 and a subsea manifold 147 that is located in the water 194. The subsea manifold 147 is an arrangement of piping (e.g., piping 188), valves, and/or other components that are configured to combine, distribute, control, monitor, and/or otherwise manipulate the fluid flowing through the piping 188 from the subsea completion system 140 and/or other subsea completion systems. The subsea manifold 147 may be a standalone component of the field system 100. Alternatively, the subsea manifold 147 may be part of another component and/or subsystem (e.g., integrated with the subsea completion system 140). In alternative embodiments, the field system 100 may include multiple subsea manifolds 147, which may be arranged in series and/or in parallel with each other.

Additional piping 188 may be used to transfer a subterranean resource between the subsea manifold 147 and one or more subsea pipelines 148. There may be one or more of a number of components and/or systems (e.g., a subsea electrical pump, a subsea compressor, a subsea process cooler) positioned between a subsea completion system 140 and the subsea pipelines 148 to assist in extracting a subterranean resource from the wellbore 111 and/or injecting a subterranean resource into the wellbore 111. There may be one or more communication links 105 and/or power transfer links 187 between one or more of the subsea components (e.g., the subsea completion system 140, a sensor device 160, a subsea manifold 147, one or more of the subsea pipelines 148) and one or more components (e.g., a generator, a controller 104, a compressor) disposed on the topsides of the floating structure 103 (or land-based structure 103, as the case may be).

Each subsea pipeline 148 (also sometimes called a submarine pipeline 148) is a series of pipes, coupled end to end, that is laid at or near to the seabed 102. A subsea pipeline 148 moves a subterranean resource from the area of the wellbore 111 to some other location, typically for a midstream process (e.g., oil refining, natural gas processing). The piping 188, also located subsea, may include multiple pipes, ducts, elbows, joints, sleeves, collars, and similar components that are coupled to each other (e.g., using coupling features such as mating threads) to establish a network for transporting the subterranean resource between the subsea completion system 140 and the subsea manifold 147, and also between the subsea manifold 147 and one or more of the subsea pipelines 148. While not shown in FIG. 1, in alternative embodiments of the field system 100, piping 188 may run from the floating structure 103 to one or more components (e.g., the subsea manifold 147). Each component of the piping 188 may have an appropriate size (e.g., inner diameter, outer diameter) and be made of an appropriate material (e.g., steel) to safely and efficiently handle the pressure, temperature, flow rate, and other characteristics of the subterranean resource at the depth in the water 194.

The riser 116 is positioned between the floating structure 103 and the subsea completion system 140. The riser 116 isolates the water 194 from the fluids flowing between the floating structure 103 and the wellbore 111. The riser 116 may be considered part of the casing string 115. The riser 116 may have any length (e.g., hundreds of feet, thousands of feet) sufficient to span approximately between the waterline 193 and the seabed 102. The riser 116 has a diameter sufficient to allow for fluid flow in either or both directions (e.g., toward the waterline 193, toward the seabed 102), which may include a tubing string.

A user 175 can be any person that interacts, directly or indirectly, with a controller 104, a sensor device 160, the driving system 180, the working fluid control system 170, a barrier 230, and/or any other component of the field system 100. Examples of a user 175 may include, but are not limited to, a company representative, an engineer, a geologist, a consultant, a contractor, and a manufacturer's representative. A user 175 can use one or more user systems 176, which may include a display (e.g., a GUI). A user system 176 of a user 175 can interact with (e.g., send data to, obtain data from) a controller 104, a sensor device 160, the driving system 180, and/or the working fluid control system 170 via an application interface and using the communication links 105.

A user 175 can also interact directly with a controller 104, a sensor device 160, the driving system 180, and/or the working fluid control system 170 through a user interface (e.g., keyboard, mouse, touchscreen). A user system 176 of a user 175 can interact with (e.g., sends data to, receives data from) a controller 104, a sensor device 160, the driving system 180, and/or the working fluid control system 170 via an application interface. Examples of a user system 176 can include, but are not limited to, a cell phone with an app, a laptop computer, a handheld device, a smart watch, a desktop computer, and an electronic tablet.

The field system 100 can include one or more controllers 104. A controller 104 of the system 100 communicates with and in some cases controls one or more of the other components (e.g., a sensor device 160, the driving system 180, the working fluid control system 170) of the field system 100. A controller 104 performs a number of functions that include obtaining and sending data, evaluating data, following protocols, running algorithms, and sending commands. A controller 104 can include one or more of a number of components. Such components of a controller 104 can include, but are not limited to, a control engine, a communication module, a timer, a counter, a power module, a storage repository, a hardware processor, memory, a transceiver, an application interface, and a security module. When there are multiple controllers 104 in the field system 100, each controller 104 can operate independently of each other. Alternatively, one or more of the controllers 104 can work cooperatively with each other. As yet another alternative, one of the controllers 104 can control some or all of one or more other controllers 104 in the field system 100. In some cases, a controller 104 is an optional component of the field system 100.

Each sensor device 160 (e.g., optional sensor device 160-1, optional sensor device 160-2) includes one or more sensors that measure one or more parameters (e.g., pressure, distance, torque, flow rate, temperature, humidity, voltage, current). Examples of a sensor of a sensor device 160 can include, but are not limited to, a proximity sensor, a magnetic field sensor, a temperature sensor, torque sensor, a flow sensor, a pressure sensor, a gas spectrometer, a voltmeter, an ammeter, a permeability meter, a porosimeter, and a camera. A sensor device 160 can be integrated with and/or measure a parameter associated with one or more components (e.g., the UCA 250 of the subsea completion system 140, the LCA 220 of the subsea completion system 140) of the field system 100. For example, a sensor device 160 can be configured to measure a parameter (e.g., torque, distance) associated with stabbing the distal end of the UCA 250 into the receptacle 225 at the top end of the LCA 220 of the subsea completion system 140.

As another example, a sensor device 160 may be configured to provide an indication when the bottom end of the tubing string 255 of the UCA 250 is stabbed into the top end of the receptacle 225 of the LCA 220. In such a case, the indication may trigger the working fluid control system 170 to raise the pressure through the working fluid 282 within the tubing string cavity 257 of the UCA 250 so that the differential force experienced by a barrier 230 (e.g., barrier 230-1) exceeds a threshold value at which the barrier 230 opens (e.g., breaks apart). In some cases, the measurements made by one or more sensor devices 160, each measuring a different parameter, can be used to determine and confirm whether a controller 104 should take a particular action (e.g., operate a valve, operate or adjust driving system 180, operate or adjust the working fluid control system 170). In some cases, a sensor device 160 can include its own controller (e.g., controller 104), or portions thereof. In some cases, a sensor device 160 is an optional component of the field system 100, or at least the subsea completion system 140.

The driving system 180 may be configured to move (e.g., raise, lower, rotate) the UCA 250 within the casing string 115, which may include the riser 116. The driving system 180 may also be configured to insert the LCA 220 into position within the casing string 115 both above and below the seabed 102 prior to inserting and lowering the UCA 250 toward the LCA 220 within the casing string 115. The driving system 180 may further be configured to lower (sometimes referred to as stabbing in) the bottom end of the tubing string 255 of the UCA 250 into the top end of the receptacle 225 of the LCA 220.

The driving system 180 may include one or more of a number of components. Such components may include, but are not limited to, a motor, a gearbox, a compressor, a valve, a sensor device (e.g., sensor device 160), piping (e.g., piping 188), a controller (e.g., controller 104), tongs, a rotating table, a drive shaft, and a protective relay. The driving system 180 may be controlled, in whole or in part, by one or more of the controllers 104. In addition, or in the alternative, the driving system 180 may include its own controller that is configured to control some or all of the driving system 180. In such a case, the controller of the driving system 180 may operate in coordination with one or more of the external controllers 104.

The working fluid control system 170 of the field system 100 is configured to control the flow of the working fluid 282 into the UCA 250 from a top end of the UCA 250. The working fluid control system 170 may also be configured to control (e.g., raise, lower) the pressure through the working fluid 282 within the tubing string cavity 257. In this way, for example, the working fluid control system 170 may raise the pressure within the tubing string cavity 257 so that the differential pressure threshold for the barrier 230-1 is exceeded, thereby causing the barrier 230-1 to open (e.g., break apart), and so open the fluidic seal with the LCA wall 224 and/or the receptacle wall 226. In such case, the barrier 230-2 may have previously been broken apart when a lower differential pressure, corresponding to the threshold value for the barrier 230-2, had been exceeded.

The working fluid control system 170 may include one or more of a number of components. Such components may include, but are not limited to, a motor, a pump, a compressor, a valve, a sensor device (e.g., sensor device 160), piping (e.g., piping 188), a controller (e.g., controller 104), a working fluid processing system, a working fluid storage system, a heater, a heat exchanger, and a protective relay. The working fluid control system 170 may be controlled, in whole or in part, by one or more of the controllers 104. In addition, or in the alternative, the working fluid control system 170 may include its own controller that is configured to control some or all of the working fluid control system 170. In such a case, the controller of the working fluid control system 170 may operate in coordination with one or more of the external controllers 104.

Each communication link 105 can include wired (e.g., Class 1 electrical cables, electrical connectors, Power Line Carrier, RS485) and/or wireless (e.g., sound or pressure waves in the water 194, Wi-Fi, Zigbee, visible light communication, cellular networking, Bluetooth, Bluetooth Low Energy (BLE), ultrawide band (UWB), WirelessHART, ISA100) technology. A communication link 105 can transmit signals (e.g., communication signals, control signals, data) from one component (e.g., a controller 104) of the field system 100 to another (e.g., a valve on the Xmas tree 177, the driving system 180, the working fluid control system 170).

Each power transfer link 187 can include one or more electrical conductors, which can be individual or part of one or more electrical cables. In some cases, as with inductive power, power can be transferred wirelessly using power transfer links 187. A power transfer link 187 can transmit power from one component (e.g., a battery, a generator) of the field system 100 to another (e.g., a motor of the driving system 180). Each power transfer link 187 can be sized (e.g., 12 gauge, 18 gauge, 4 gauge) in a manner suitable for the amount (e.g., 480V, 24V, 120V) and type (e.g., alternating current, direct current) of power transferred therethrough.

FIGS. 3 through 6 show implementation of a subsea completion system 340 over time according to certain example embodiments. Referring to the description above with respect to FIGS. 1 and 2, the subsea completion system 340 shown in FIG. 3 includes a casing string 315 (which may include part of a riser, such as riser 116), a production packer 359, a LCA 320, and a Xmas tree 377. Each of these components (including portions thereof, such as the receptacle 325 of the LCA 320) may be substantially the same as the corresponding component (or portion thereof) discussed above with respect to FIGS. 1 and 2. The order of steps listed below with respect to FIGS. 3 through 6 may vary in different embodiments.

Figure 3:
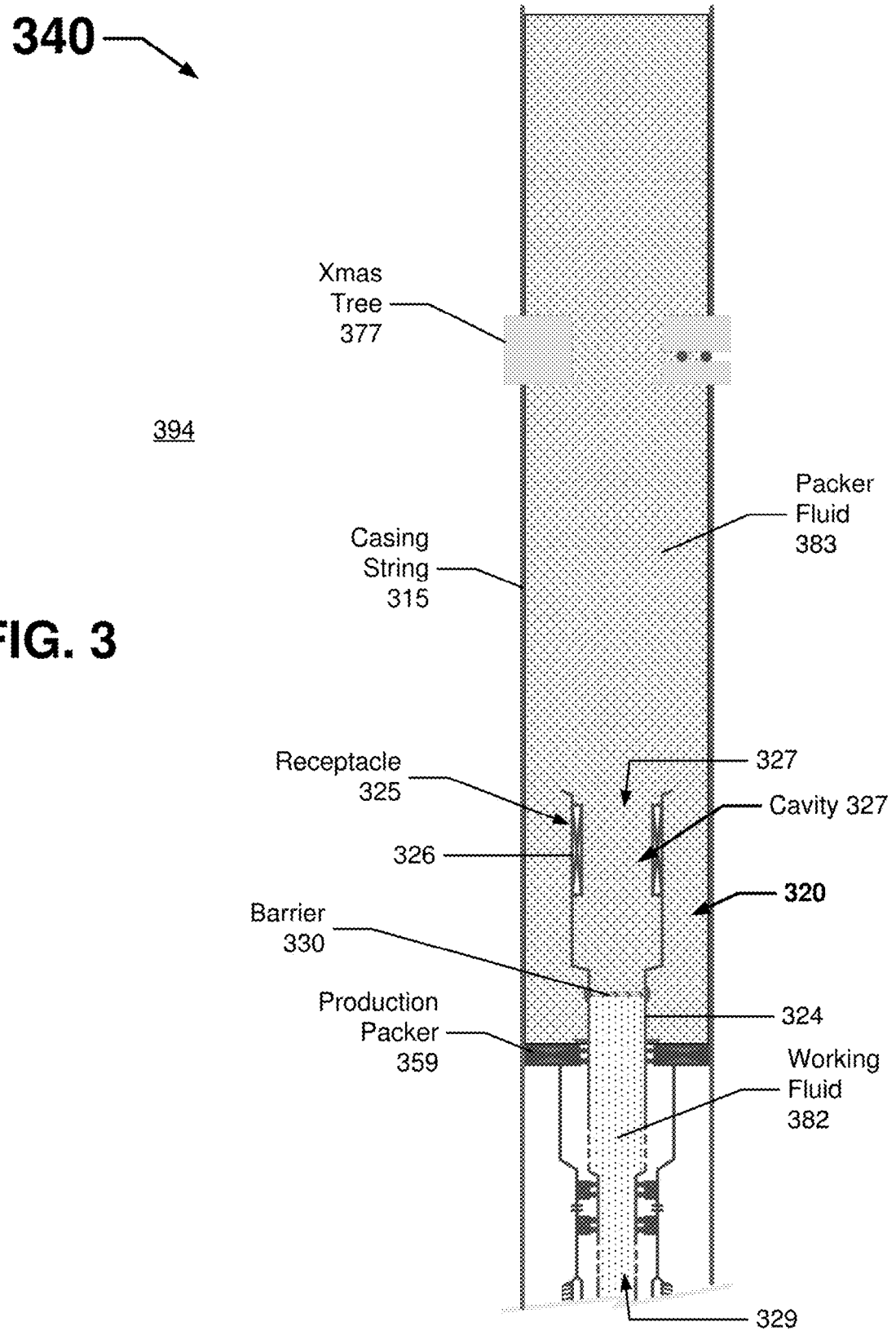
FIGS. 3 through 6 show implementation of a subsea completion system according to certain example embodiments.

At the point in time captured in FIG. 3, the LCA 320 has been inserted into the casing string 315. The LCA 320 includes a receptacle 325 that is placed at the top end of the LCA 320. The receptacle wall 326 has a diameter that is larger than the diameter of the LCA wall 324 and the diameter of the tubing string 355 of the UCA 450. Positioned within the cavity 329 of the LCA 320 (and possibly within the cavity 327 of the receptacle 325) is a barrier 330, which creates a fluidic seal with the LCA wall 324 of the LCA 320 (which may include the receptacle wall 326 of the receptacle 325). In this case, before the barrier 330 is placed within the cavity 329 of the LCA 320, working fluid 382 is injected into the cavity 329 of the LCA 320. The working fluid 382 may be injected into the cavity 329 of the LCA 320 using a working fluid control system (e.g., working fluid control system 170).

After the LCA 320 is inserted into the casing string 315, the production packer 359 may then be set within the casing string 315 toward the bottom of the casing string 315. The production packer 359 may be a short hollow cylinder, as in this example. The production packer 359 abuts against the inner surface of the wall of the casing string 315 along its outer perimeter, and the production packer 359 abuts against the outer surface of the LCA wall 324 along its inner perimeter. Under this configuration, the production packer 359 creates a fluidic seal with the wall 324 of the LCA 320 and with the casing string 315.

Prior to the production packer 359 being set, the Xmas tree 377 may be set in and around the casing string 315 above the LCA 320. The Xmas tree 377 in this case is a horizontal tree with two valves set within the horizontal exit channel. The Xmas tree 377 in this example also has a shoulder onto which the tubing hanger 366 (discussed below) rests. The Xmas tree 377 may be put into place using various equipment, including but not limited to a crane, a remotely operated vehicle (ROV), and divers. Some or all of the Xmas tree 377 may be preassembled (e.g., on a production floor on land, on a floating structure 103) prior to being submerged into the water 394.

After the Xmas tree 377 is set, packer fluid 383 may be injected into the casing string 315. The packer fluid 383 may be injected into the casing string 315 using a system that operates similarly to a working fluid control system 170, but applied to packer fluid 383 rather than working fluid 382. As a result of the fluidic seal created by the production packer 359, the packer fluid 383 remains above the production packer 359 within the casing string 315, and none of the packer fluid 383 is below the production packer 359 within the casing string 315. The contents of the packer fluid 383 may be damaging to the subterranean formation (e.g., subterranean formation 110), inhibiting the ability to extract subterranean resources. As a result, an objective of the field operation is to minimize the amount of packer fluid 383 that reaches the subterranean formation.

Figure 4:
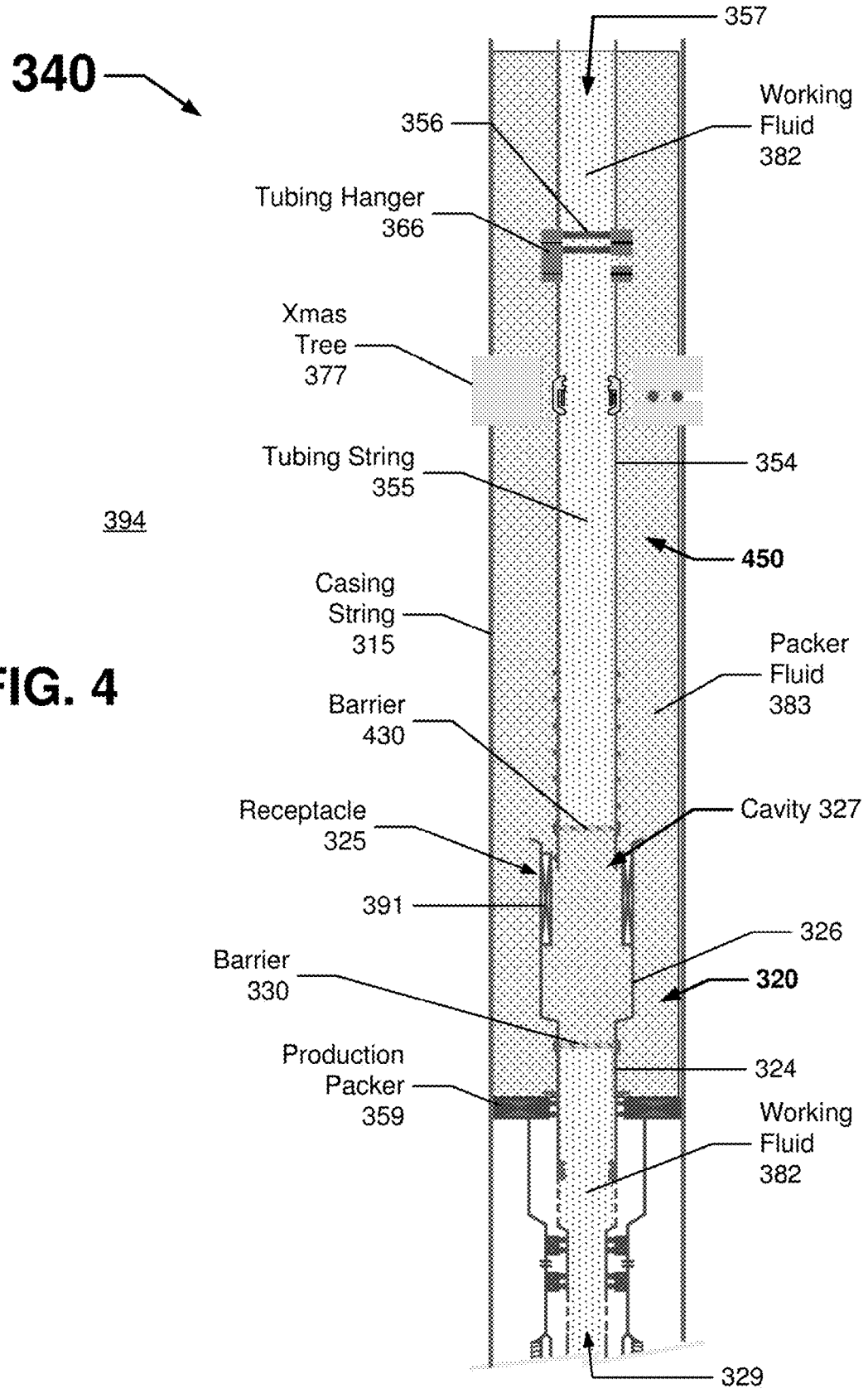

At the point of time captured in FIG. 4, which follows the point in time captured in FIG. 3, the UCA 450 may be inserted into the casing string 315. The UCA 450 in this case includes a tubing string 355, a tubing hanger 366, and a barrier 430. The barrier 430 is placed toward the distal (bottom) end of the UCA 450. The position of the tubing hanger 366 on the UCA 450 is configured to coincide with the location of the Xmas tree 377 within the casing string 315 relative to the receptacle 325 and the barrier 330 of the LCA 320. The tubing hanger 366 is positioned above the barrier 430 on the UCA 450. The tubing hanger 366 includes 2 crown plugs 356.

The cavity 357 of the tubing string 355 of the UCA 450 is filled with working fluid 382. Since the barrier 430 creates a fluidic seal with the wall 354 of the tubing string 355, the working fluid 382 remains above the barrier 430, and none of the packer fluid 383 mixes with the working fluid 382 in the cavity 357. The working fluid 382 may be injected into the cavity 357 of the tubing string 355 of the UCA 450 using a working fluid control system (e.g., working fluid control system 170).

As shown in FIG. 4, the distal end of the tubing string 355 of the UCA 450 has just been lowered into the top of the receptacle cavity 327 of the receptacle 325. In certain example embodiments, as in this case, the inner surface of the receptacle wall 326 and/or the outer surface of the distal end of the tubing string 355 include one or more sealing members 391 (e.g., gaskets, O-rings) that create a fluidic seal, even as the tubing string 355 of the UCA 450 continues to be stabbed further downward within the casing string 315. As a result, the cavity 327 of the receptacle 325, filled with packer fluid 383 but sealed off by the sealing members 391 of the tubing string 355 and/or the receptacle 325, becomes smaller and smaller as the UCA 450 is lowered further until the UCA 450 has reached its final position, which in this case is when the tubing hanger 366 is seated within the Xmas tree 377. Further, the barrier 330 prevents any of the packer fluid 383 from mixing with the working fluid 382 within the cavity 329 of the LCA 320, and the barrier 430 prevents any of the packer fluid 383 from mixing with the working fluid 382 within the cavity 357 of the tubing string 355 of the UCA 450.

Figure 5:
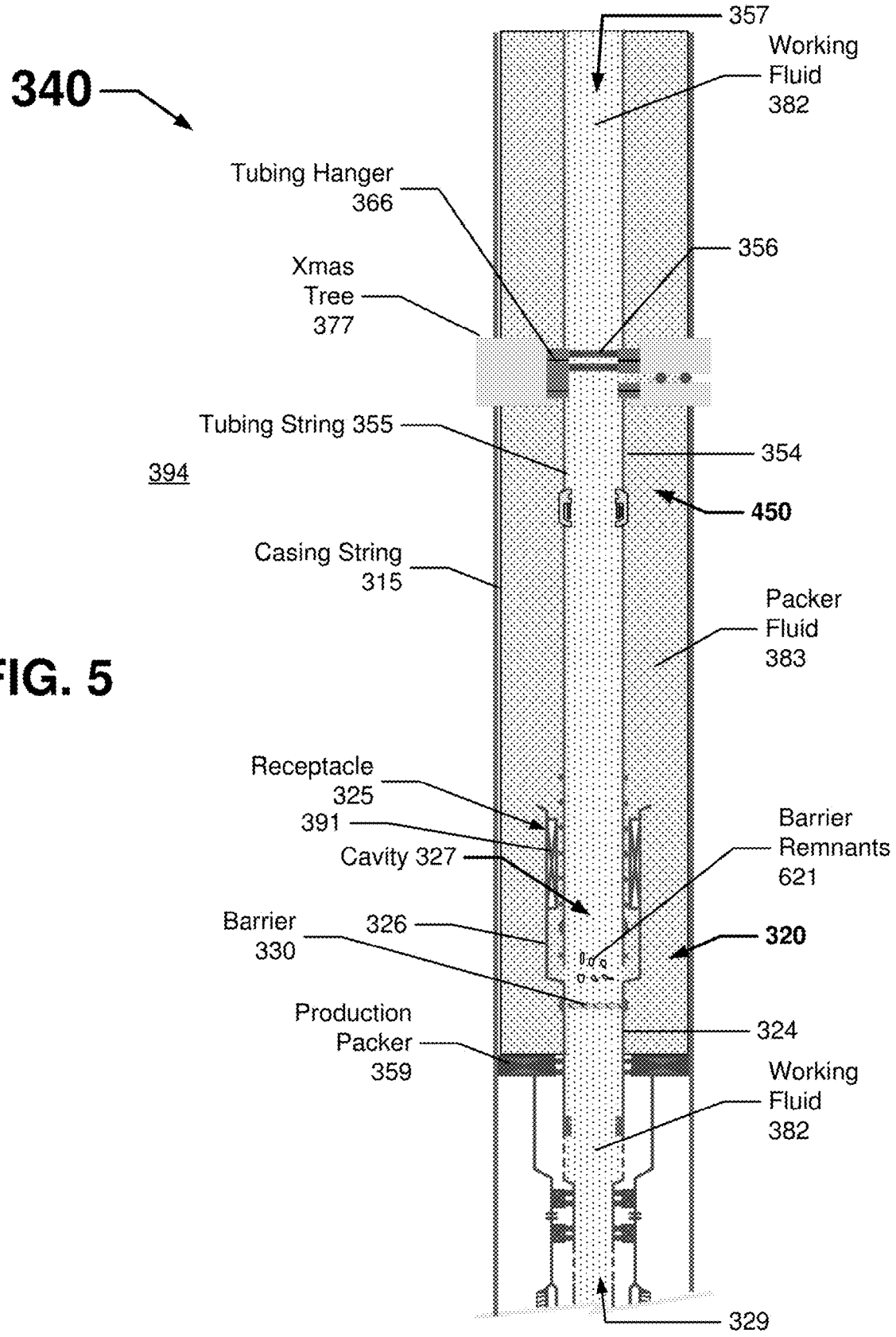

At the point of time captured in FIG. 5, which follows the point in time captured in FIG. 4, the UCA 450 is inserted even further into the casing string 315. At this point in time, the UCA 450 is lowered further relative to what is shown in FIG. 4 until the tubing hanger 366 is seated within the Xmas tree 377. At this point, the UCA 450 cannot be lowered any further. This position of the UCA 450 relative to the LCA 320 may additionally or alternatively be indicated by the use of one or more sensor devices (e.g., sensor device 160-1, sensor service 160-2). When this occurs, the size of the cavity 327 of the receptacle 325 is even smaller than what is shown in FIG. 4. Since the cavity 327 is filled with packer fluid 383, and since the sealing members 391 of the tubing string 355 and/or the receptacle 325 prevent the packer fluid 383 from escaping the shrinking cavity 327, the resulting buildup of pressure within the cavity 327 applies a large differential force on the barrier 330 and the barrier 430.

In this example, the threshold value of the differential force for the barrier 430 is lower than the threshold value of the differential force for the barrier 330. Therefore, assuming the pressure in the cavity 357 of the tubing string 355 of the UCA 450 is substantially the same as the pressure in the cavity 329 of the LCA 320, the barrier 330 and the barrier 430 experience substantially the same differential force. When the threshold value for the barrier 430 is lower than the threshold value for the barrier 330, as in this case, the barrier 430 opens (e.g., breaks apart) when the differential force reaches the threshold value for the barrier 430 while the barrier 330 remains intact. When the barrier 430 opens by breaking apart, barrier remnants 621 are scattered in the cavity 327 above the barrier 330. Also, the working fluid 382 in the cavity 357 of the tubing string 355 of the UCA 450 mixes with the packer fluid 383 in the cavity 327. In certain example embodiments, the barrier 430 breaks apart into the barrier remnants 621 before the tubing hanger 366 lands on the Xmas tree 377.

Figure 6:
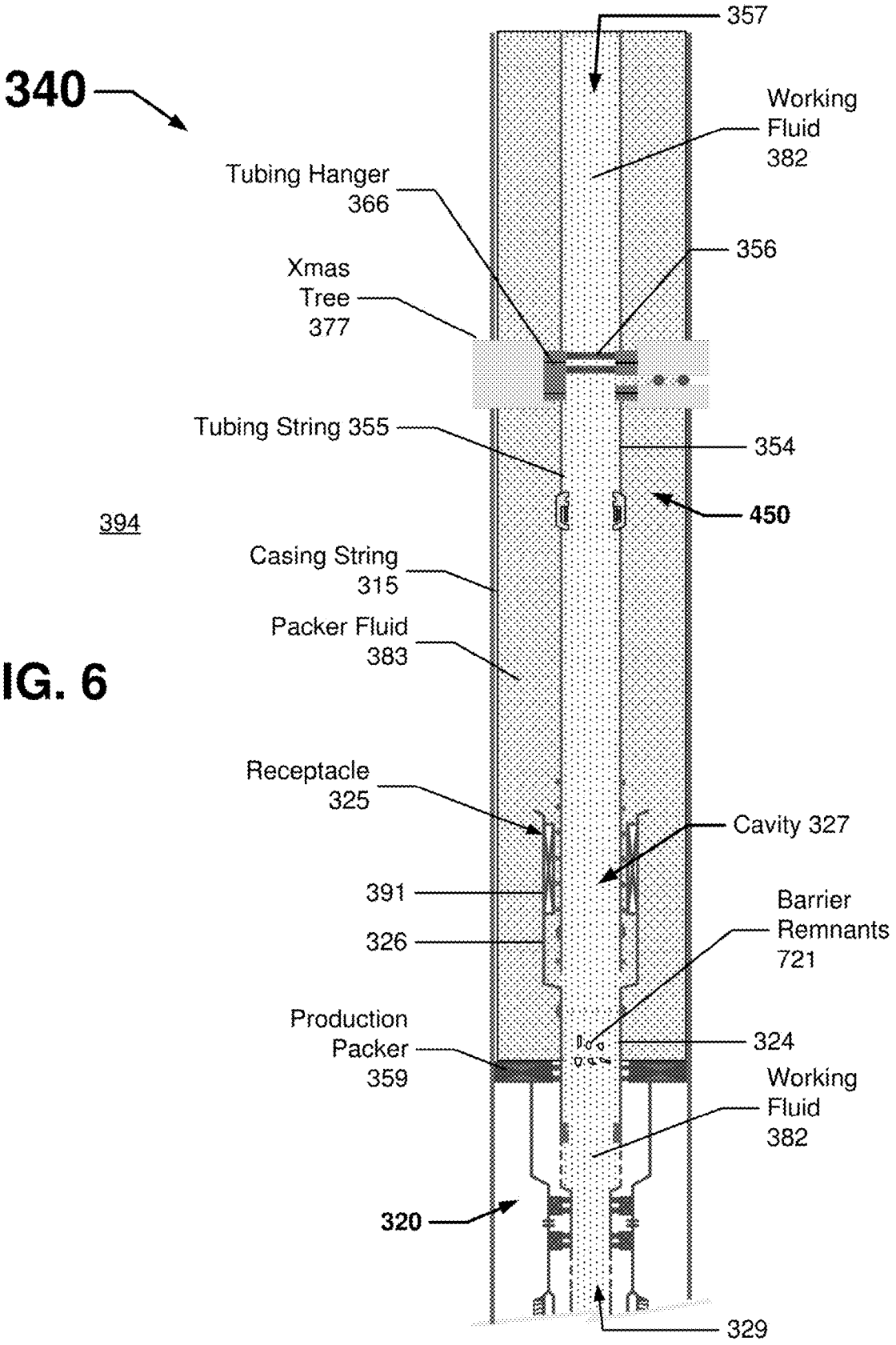

At the point of time captured in FIG. 6, which follows the point in time captured in FIG. 5, a sufficiently large differential force is applied to the barrier 330 through the working fluid 382 in the cavity 357 of the tubing string 355 of the UCA 450 to open (e.g., break) the barrier 330, resulting in barrier remnants 721 of the barrier 330 to remain in the now combined cavity that includes cavity 357, cavity 327, and cavity 329. The working fluid 382 that was previously in the cavity 357 in the UCA 450 and the working fluid 382 that was previously in the cavity 329 of the LCA 320 are now combined, and the combined cavity spans the entire height of the casing string 315.

Using this example process shown and described with respect to FIGS. 3 through 6, the crown plugs 356, pre-installed (e.g., on land), are run quickly, safely, and effectively, saving 3 to 5 days of installing them using methods currently known in the art. This example process also saves tremendous amounts of money and avoids tremendous safety risks that apply to personnel and equipment. For instance, this example process avoids the need to rig up a CCTLF, rig up a SFT tool, rig up a slickline, run the slickline to retrieve the isolation sleeve, install the crown plugs, rig down the slickline, rig down the SFT, and rig down the CCTLF.

Figure 7:
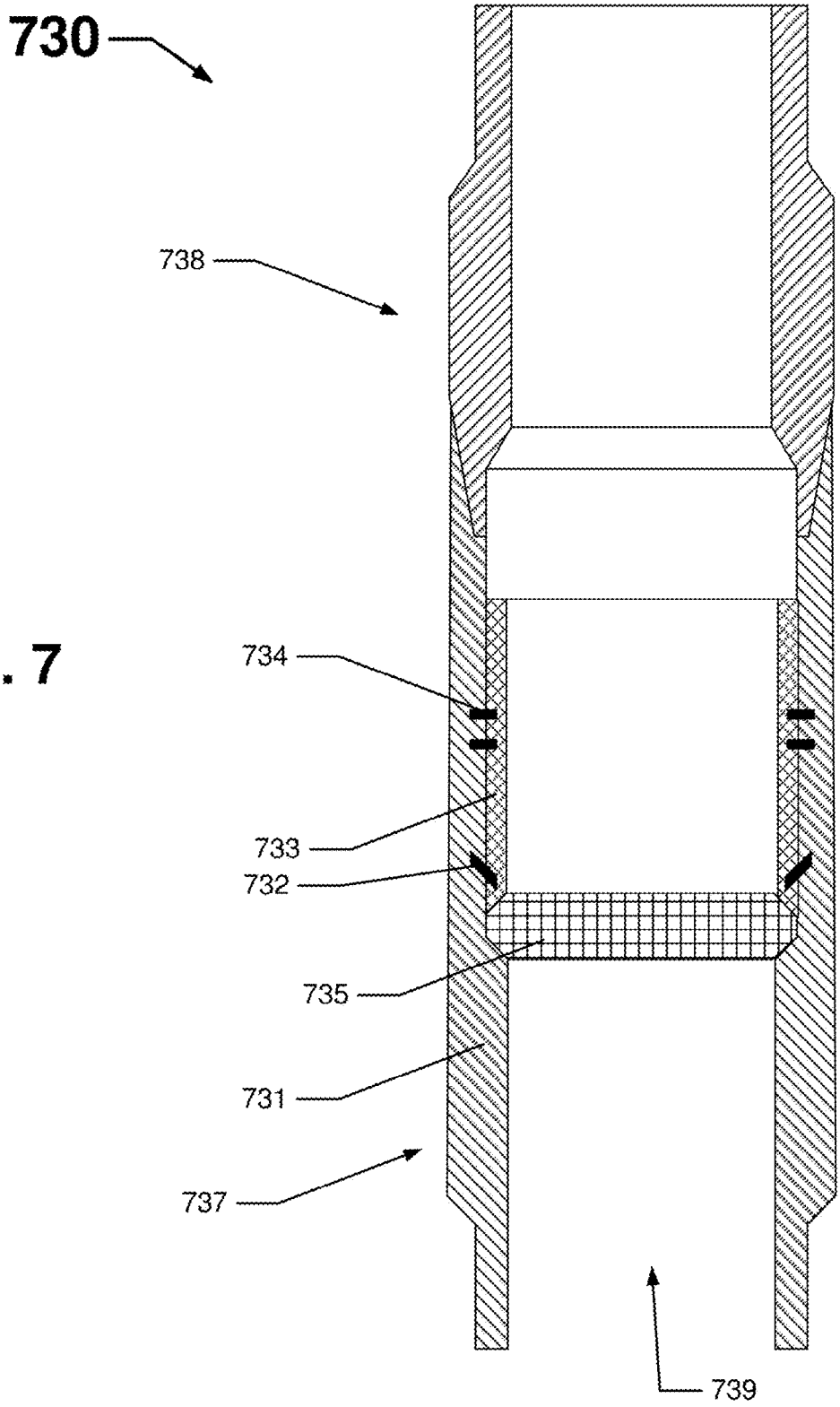
FIG. 7 shows a cross-sectional side view of a barrier used with an example subsea completion system according to certain example embodiments.

FIG. 7 shows a cross-sectional side view of an example of a barrier 730 used with an example subsea completion system according to certain example embodiments. Referring to the description above with respect to FIGS. 1 through 6, the barrier 730 of FIG. 7 is an example of the barriers (e.g., barrier 330) discussed above. In this case, the barrier 730 is a sub that is configured to be integrated with a tubing string (e.g., tubing string 355) or a LCA (e.g., LCA 320). For example, the barrier 730 in the form of a sub may have mating threads that allow the barrier 730 to be threadably coupled to a tubing pipe on both ends so that the barrier 730 is in line with the adjacent tubing pipes as part of the tubing string.

The barrier 730 may be a specially designed product or an off-the-shelf product that is available in the current art. In this case, however, the barrier 730 may be inverted from its normal orientation during use in the current art. Specifically, the upper housing 737 (also called the box) in this case may be positioned at the downstream end, and the lower housing 738 (also called the pin) in this case may be positioned at the upstream end. The barrier 730 has a wall 731 that forms a cavity 739 along its length. Inside the cavity 739 are positioned a disc 735 (e.g., made of glass, made of ceramics), one or more shear pins 734, a piercing device 732, and a sliding sleeve 733.

Each shear pin 734 is configured to shear when a differential force applied to the disc 735 within the cavity 739 (which coincides with the cavity (e.g., cavity 329, cavity 357) of the LCA (e.g., LCA 320) or UCA (e.g., UCA 450) into which the barrier 730 is integrated) reaches a threshold value. Each shear pin 734 has one end anchored in an aperture in the inner surface of the wall 731 of the barrier 730. The other end of the shear pin 734 is positioned in an aperture in the wall of the sliding sleeve 733. When at least one shear pin 734 is intact, the shear pin 734 fixes the position of the sliding sleeve 733 within the cavity 739.

The sliding sleeve 733 does not move until all shear pins 734 have sheared. As more shear pins 734 are used with the barrier 730, the threshold value of the differential force required to shear the shear pins 734 increases. In this way, the threshold value of the differential force to activate (e.g., open, break, shear) the barrier 730 may be calibrated (e.g., by a user in the field, at a manufacturer's facility) or otherwise tailored for the operating conditions of a particular field system (e.g., field system 100).

The sliding sleeve 733 of the barrier 730 has a limited range of motion within an elongated slot or recess in the inner surface of the wall 731. As discussed above, if at least one shear pin 734 is intact, the position of the sliding sleeve 733 remains fixed within the cavity 739. If all of the shear pins 734 have sheared, then the sliding sleeve 733 is free to move within the cavity 739, albeit within a limited range of motion. When the orientation of the barrier 730 is inverted, as in this case, pressure building up in the cavity 739 as the UCA (e.g., UCA 450) is lowered causes the disc 735 to apply an upward force to the sliding sleeve 733. When the upward force applied by the disc 735 overcomes the shear pins 734, the glass disc 735 and sliding sleeve 733 move upwards together. In its upward travel, when the disc 735 contacts the piercing device 732, the disc 735 breaks, which opens (e.g., breaks) the fluidic seal that the disc 735 maintained to that point in time.

The piercing device 732 is used to break the disc 735 when the barrier 730 is installed in a normal position (upside down from what is shown in FIG. 7). Specifically, in a normal orientation of the barrier 730, when all of the shear pins 734 shear, the sliding sleeve 733 moves away from the disc 735, allowing the disc 735 to follow the sliding sleeve 733. The piercing device 732 is fixed in the wall 731 and sticks out enough from the wall 731 to be contacted by the disc 735 as the disc 735 follows the sliding sleeve 733. When the piercing device 732 is contacted by the disc 735, the disc 735 breaks.

The disc 735 may be made of any of a number of suitable materials (e.g., glass, ceramics). The thickness of the disc 735 is large enough to withstand the differential forces required to maintain a fluidic seal up until the threshold value set for the barrier 730. When the barrier 730 is oriented in an inverted position, the disc 735 may be configured to break when the disc 735, after applying a sufficiently strong upward force against the sliding sleeve 733 to overcome the shear pins 734, collides with the piercing device 732.

FIGS. 8 through 11 show implementation of another subsea completion system 840 according to certain example embodiments. Referring to the description above with respect to FIGS. 1 through 7, the subsea completion system 840 shown in FIG. 8 includes a casing string 815 (which may include part of a riser, such as riser 116), a production packer 859, a LCA 820, a UCA 850, and a Xmas tree 877. Each of these components (including portions thereof, such as the receptacle 825 of the LCA 820 or the tubing hanger 866 and crown plugs 856 of the UCA 850) may be substantially the same as the corresponding component (or portion thereof) discussed above with respect to FIGS. 1 through 7. The order of steps listed below with respect to FIGS. 8 through 11 may vary in different embodiments.

Figure 8:
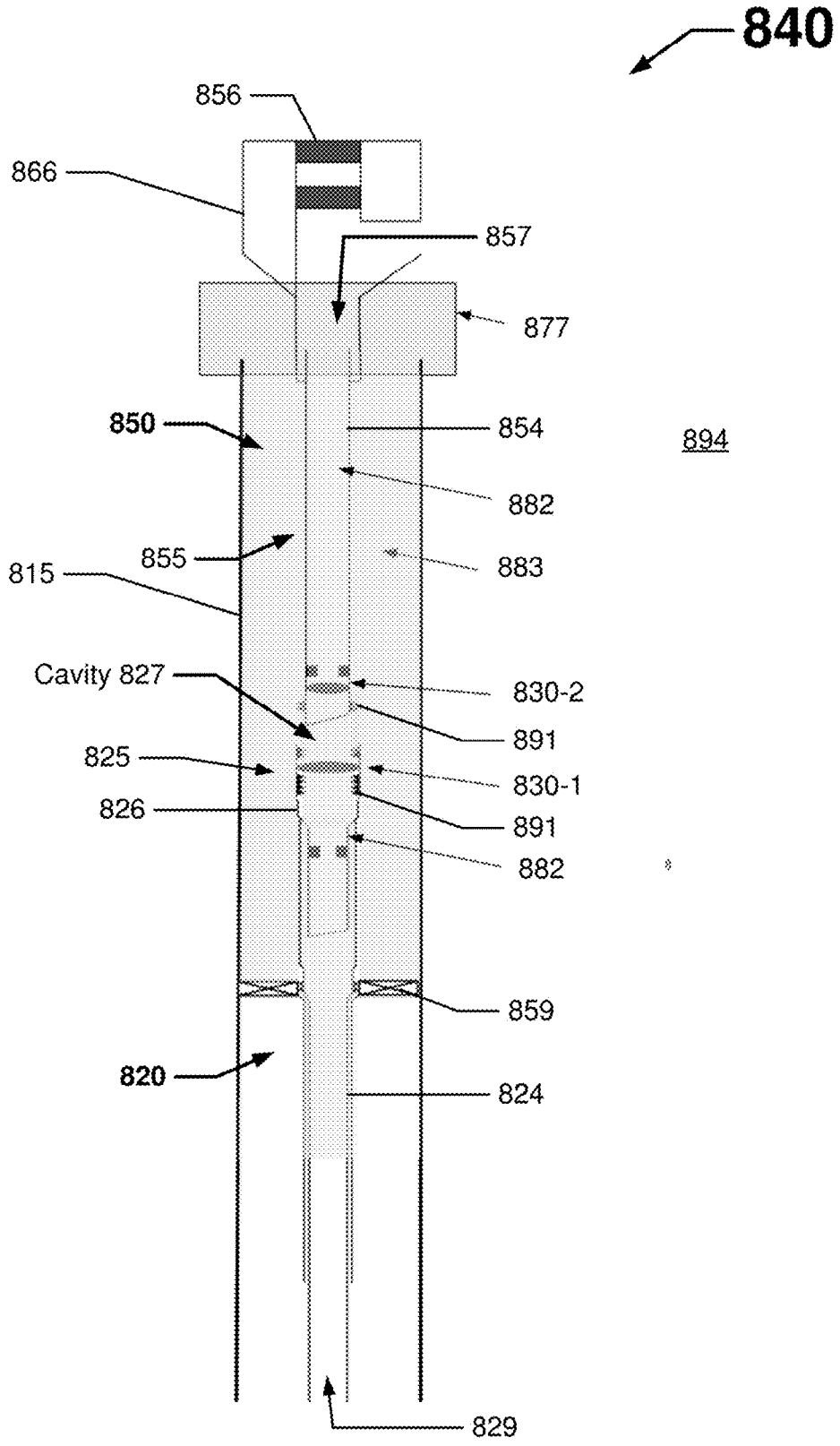
FIGS. 8 through 11 show implementation of another subsea completion system according to certain example embodiments.

At the point in time captured in FIG. 8, the LCA 820 has been inserted into the casing string 815. The LCA 820 includes a receptacle 825 that is placed at the top end of the LCA 820. The receptacle wall 826 has a diameter that is larger than the diameter of the LCA wall 824 and the diameter of the tubing string 855 of the UCA 850. Positioned within the cavity 829 of the LCA 820 (and possibly within the cavity 827 of the receptacle 825) is a barrier 830-1, which creates a fluidic seal with the LCA wall 824 of the LCA 820 (which may include the receptacle wall 826 of the receptacle 825). In this case, before the barrier 830-1 is placed within the cavity 829 of the LCA 820, working fluid 882 is injected into the cavity 829 of the LCA 820. The working fluid 882 may be injected into the cavity 829 of the LCA 820 using a working fluid control system (e.g., working fluid control system 170).

After the LCA 820 is inserted into the casing string 815, the production packer 859 may then be set within the casing string 815 toward the bottom of the casing string 815. The production packer 859 may be a short hollow cylinder, as in this example. The production packer 859 abuts against the inner surface of the wall of the casing string 815 along its outer perimeter, and the production packer 859 abuts against the outer surface of the LCA wall 824 along its inner perimeter. Under this configuration, the production packer 859 creates a fluidic seal with the wall 824 of the LCA 820 and with the casing string 815.

After the production packer 859 is set, the Xmas tree 877 may be set in and around the casing string 815 above the LCA 820. The Xmas tree 877 in this case may be a horizontal tree. The Xmas tree 877 in this example also has a shoulder onto which the tubing hanger 866 (discussed below) rests. The Xmas tree 877 may be put into place using various equipment, including but not limited to a crane, a remotely operated vehicle (ROV), and divers. Some or all of the Xmas tree 877 may be preassembled (e.g., on a production floor on land, on a floating structure 103) prior to being submerged into the water 894.

After the Xmas tree 877 is set, packer fluid 883 may be injected into the casing string 815. The packer fluid 883 may be injected into the casing string 815 using a system that operates similarly to a working fluid control system 170, but applied to packer fluid 883 rather than the working fluid 882. As a result of the fluidic seal created by the production packer 859 and the barrier 830-1, the packer fluid 883 remains above the production packer 859 within the casing string 815, and none of the packer fluid 883 is below the production packer 859 within the casing string 815. The contents of the packer fluid 883 may be damaging to the subterranean formation (e.g., subterranean formation 110), inhibiting the ability to extract subterranean resources. As a result, an objective of the field operation is to minimize the amount of packer fluid 883 that reaches the subterranean formation.

After the packer fluid 883 is injected into the casing string 815, the UCA 850 may be inserted into the casing string 815. The UCA 850 in this case includes a tubing string 855, a tubing hanger 866, and a barrier 830-2. The barrier 830-2 is placed toward the distal (bottom) end of the UCA 850. The position of the tubing hanger 866 on the UCA 850 is configured to coincide with the location of the Xmas tree 877 within the casing string 815 relative to the receptacle 825 and the barrier 830-1 of the LCA 820. The tubing hanger 866 is positioned above the barrier 830-2 on the UCA 850. The tubing hanger 866 includes 2 crown plugs 856.

The cavity 857 of the tubing string 855 of the UCA 850 is filled with working fluid 882. Since the barrier 830-2 creates a fluidic seal with the wall 854 of the casing string 855, the working fluid 882 remains above the barrier 830-2, and none of the packer fluid 883 mixes with the working fluid 882 in the cavity 857. The working fluid 882 may be injected into the cavity 857 of the tubing string 855 of the UCA 850 using a working fluid control system (e.g., working fluid control system 170).

Figure 9:
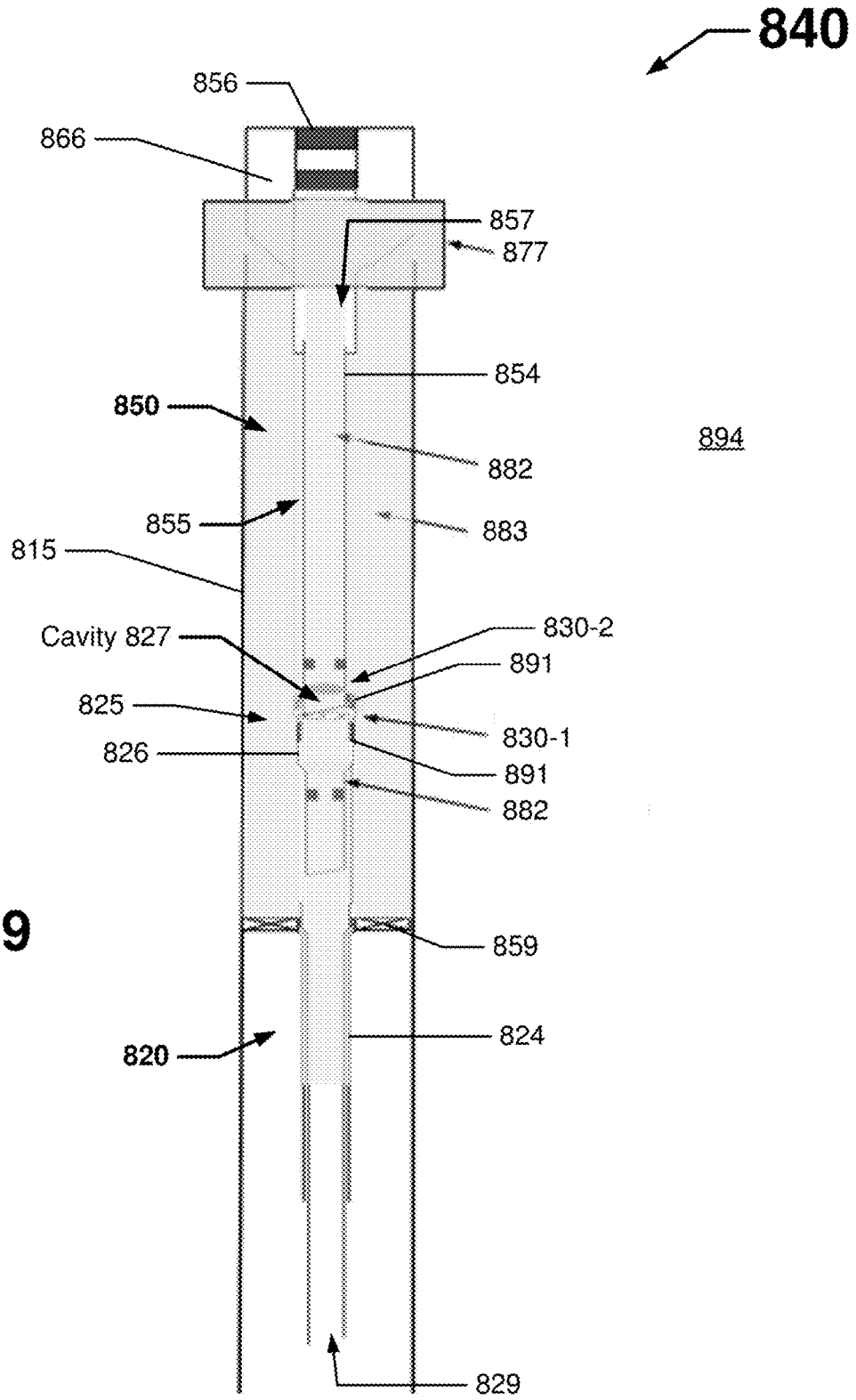

As shown in FIG. 9, the distal end of the tubing string 855 of the UCA 850 has just been lowered into the top of the receptacle cavity 827 of the receptacle 825. In certain example embodiments, as in this case, the inner surface of the receptacle wall 826 and/or the outer surface of the distal end of the tubing string 855 include one or more sealing members 891 (e.g., gaskets, O-rings) that create a fluidic seal, even as the tubing string 855 of the UCA 850 continues to be stabbed further downward within the casing string 815. As a result, the cavity 827 of the receptacle 825, filled with packer fluid 883 but sealed off by the sealing members 891 of the tubing string 855 and/or the receptacle 825, becomes smaller and smaller as the UCA 850 is lowered further until the UCA 850 has reached its final position, which in this case is when the tubing hanger 866 is seated within the Xmas tree 877. Further, the barrier 830-1 prevents any of the packer fluid 883 from mixing with the working fluid 882 within the cavity 829 of the LCA 820, and the barrier 830-2 prevents any of the packer fluid 883 from mixing with the working fluid 882 within the cavity 857 of the tubing string 855 of the UCA 850.

Figure 10:
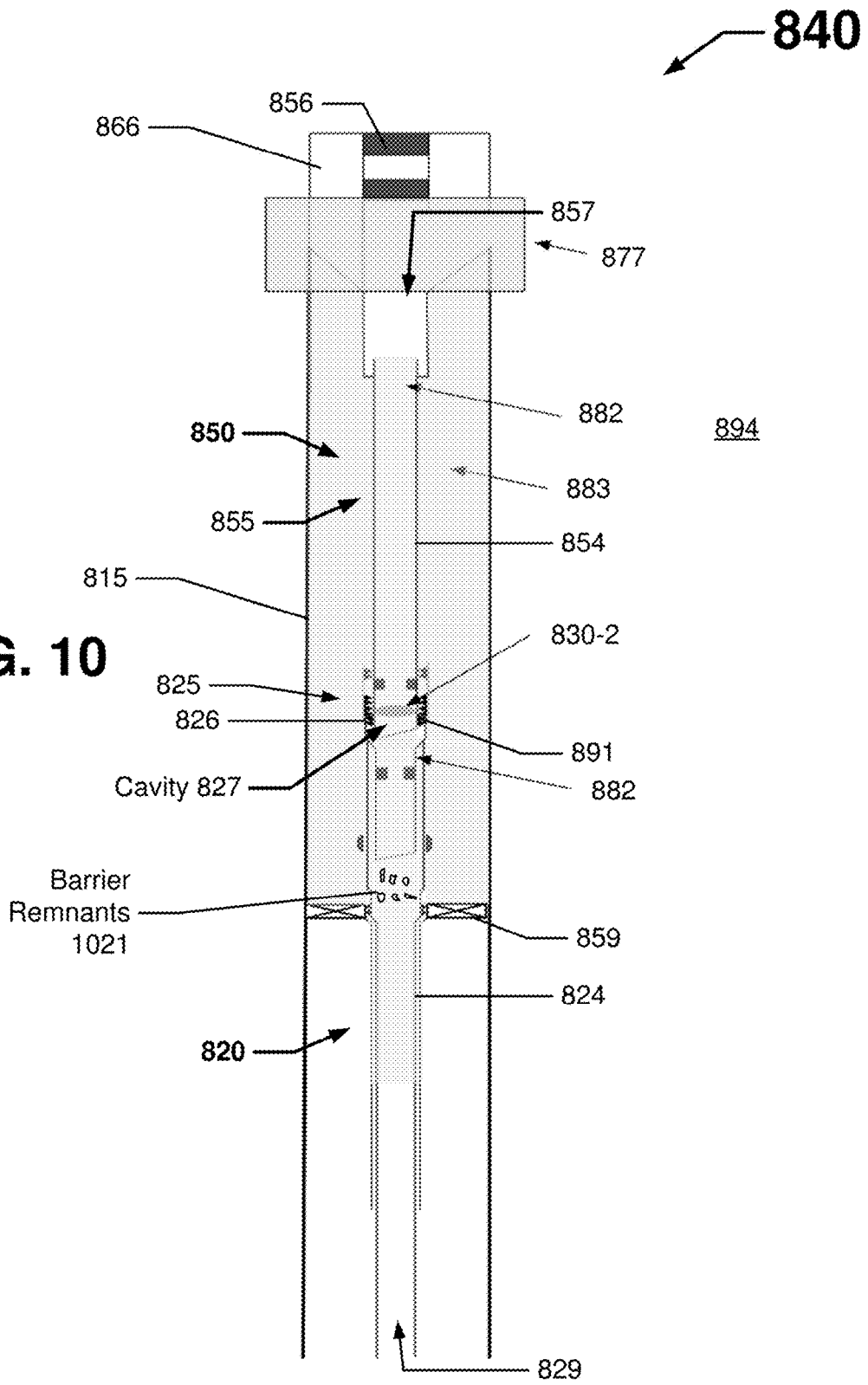

At the point of time captured in FIG. 10, which follows the point in time captured in FIG. 9, the UCA 850 is inserted even further into the casing string 815. At this point in time, the UCA 850 is lowered further relative to what is shown in FIG. 8 until the tubing hanger 866 is seated within the Xmas tree 877. At this point, the UCA 850 cannot be lowered any further. This position of the UCA 850 relative to the LCA 820 may additionally or alternatively be indicated by the use of one or more sensor devices (e.g., sensor device 160-1, sensor device 160-2).

Just prior to the time shown in FIG. 10, and just after the time shown in FIG. 9, the distal end of the UCA 850 contacts and opens (e.g., breaks) the barrier 830-1. In other words, the momentum of the distal end of the UCA 850 provides sufficient differential force to the barrier 830-1 to exceed the threshold value for the barrier 830-1. As a result, as shown in FIG. 10, the barrier 830-1 is gone and barrier remnants 1021 of the barrier 830-1 are shown in the cavity 829. The barrier remnants 1021 are located below the barrier 830-2. Also, the packer fluid 883 in the cavity 827 of the receptacle 825 mixes with the packer fluid 882 in the cavity 829.

In this example, the threshold value of the differential force for the barrier 830-1 may be lower or higher than the threshold value of the differential force for the barrier 830-2. At the time shown in FIG. 10, the barrier 830-2 of the UCA 850 remains intact. Consequently, the differential force applied to the barrier 830-2 as the UCA 850 is stabbed into the receptacle 825 of the LCA 820 and as the distal end of the UCA 850 opens (e.g., breaks) the barrier 830-1 is not sufficient to exceed the threshold value of the barrier 830-2.

Figure 11:
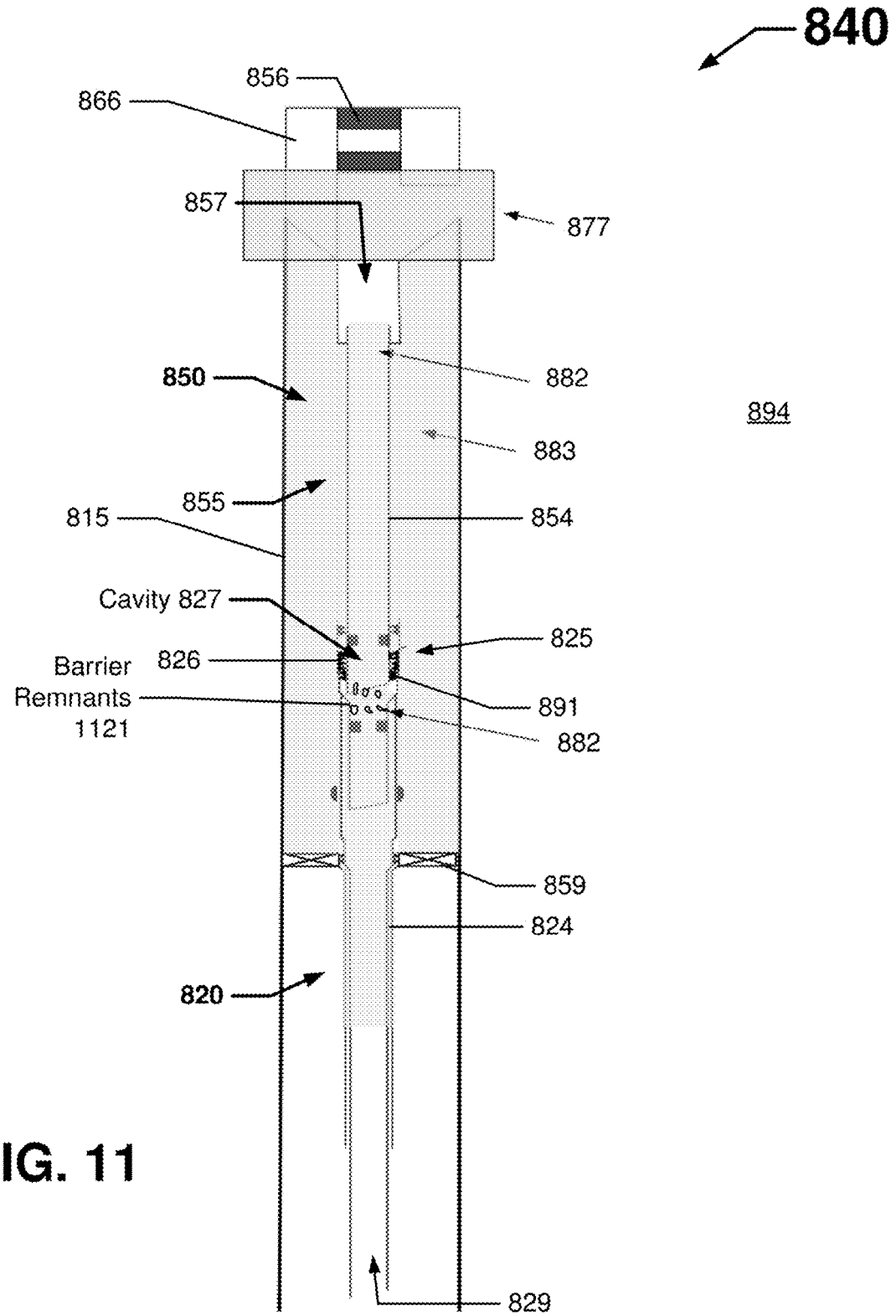

At the point of time captured in FIG. 11, which follows the point in time captured in FIG. 10, a sufficiently large differential force is applied to the barrier 830-2 through the working fluid 882 in the cavity 857 of the tubing string 855 of the UCA 850 to open (in this case, break) the barrier 830-2, resulting in barrier remnants 1121 of the barrier 830-2 to remain in the now combined cavity that includes cavity 857, cavity 827, and cavity 829. The working fluid 882 that was previously in the cavity 857 in the UCA 850 and the working fluid 882 that was previously in the cavity 829 of the LCA 820 are now combined, and the combined cavity spans the entire height of the casing string 815.

Using this example process shown and described with respect to FIGS. 8 through 11, the crown plugs 856 are run and installed quickly, safely, and effectively, saving 3 to 5 days of down time installing them using methods currently known in the art. This example process also saves tremendous amounts of money and avoids tremendous safety risks that apply to personnel and equipment. For instance, this example process avoids the need to rig up a CCTLF, rig up a SFT tool, rig up a slickline, run the slickline to retrieve the isolation sleeve, install the crown plugs, rig down the slickline, rig down the SFT, and rig down the CCTLF.

Figure 12:
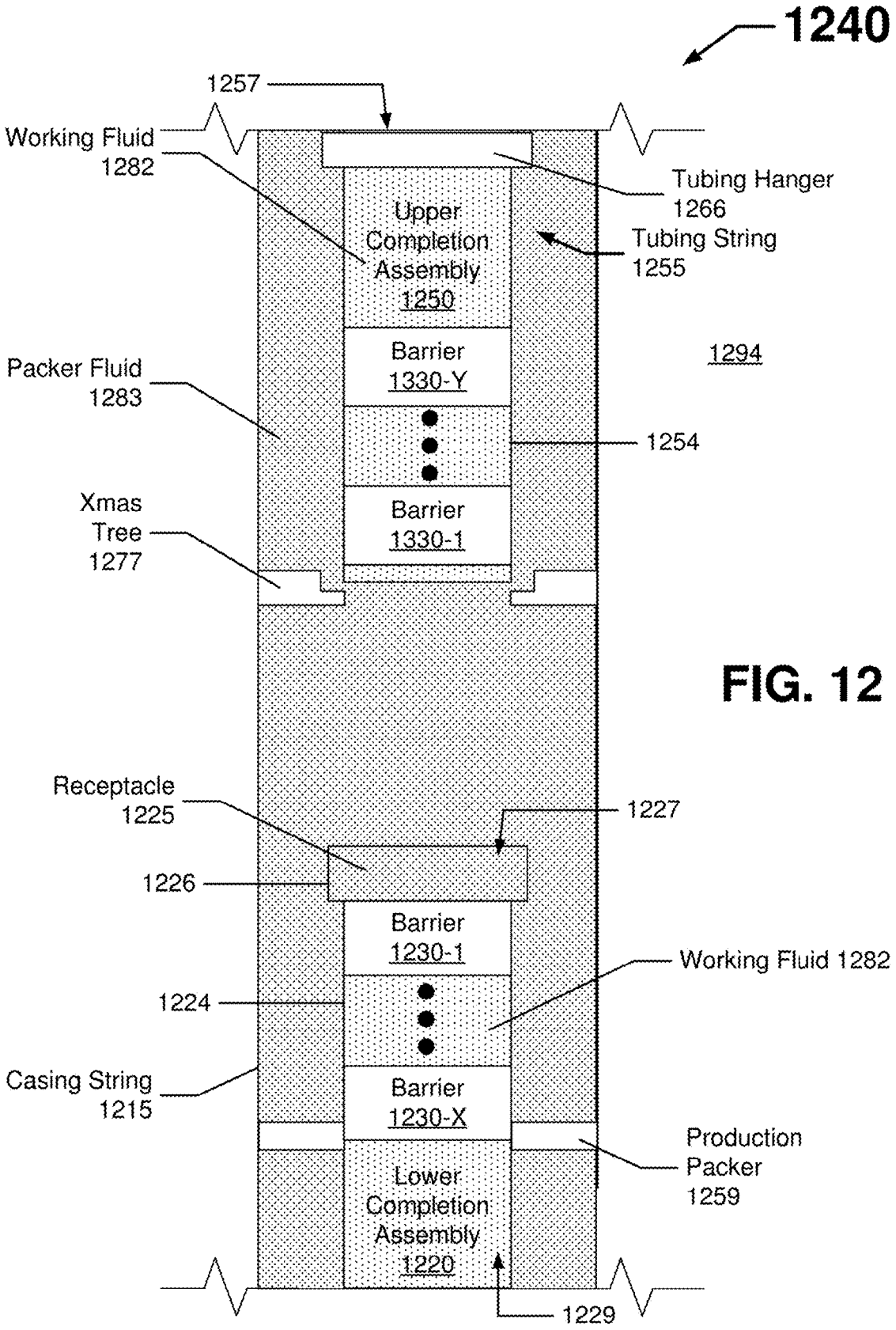
FIG. 12 shows part of a subsea completion system according to certain example embodiments.

FIG. 12 shows part of a subsea completion system 1240 according to certain example embodiments. Referring to the description above with respect to FIGS. 1 through 11, the subsea completion system 1240 shown in FIG. 12 is substantially similar to the subsea completion system 140 discussed above with respect to FIG. 2, except as described below. For example, the subsea completion system 1240 shown in FIG. 12 includes a UCA 1250, a LCA 1220, and a subsea Xmas tree 1277 located within part of the casing string 1215, which itself is located, at least in part, in water 1294. The subsea Xmas tree 1277 of the subsea completion system 1240 in this case may be a horizontal tree.

The LCA 1220 of the subsea completion system 1240 in this case includes a receptacle 1225 disposed at a top end of the LCA 1220. The receptacle 1225 has a receptacle wall 1226 that forms a receptacle cavity 1227 that runs along the height of the receptacle 1225. The receptacle 1225 may take any of a number of forms. For example, the receptacle 1225 may be or include a polished bore receptacle (PBR). The diameter of the receptacle wall 1226 may be larger than the diameter (defined by a wall 1224) of the rest of the LCA 1220 and larger than the diameter (defined by a wall 1254) of the tubing string 1255 of the UCA 1250.

In this example, there may be multiple barriers 1230 integrated with the LCA 1220. Specifically, there are X barriers 1230 (barrier 1230-1 through barrier 1230-X) within the receptacle cavity 1227 of the receptacle 1225 and/or the cavity 1229 of the remainder of the LCA 1220. The barriers 1230 are aligned in series with each other. Adjacent barriers 1230 are separated from each other by a distance within the receptacle cavity 1227 of the receptacle 1225 and/or the cavity 1229 of the remainder of the LCA 1220. The characteristics (e.g., thickness, material, configurability, configuration, differential force threshold value) of one barrier 1230 may be the same as, or different than, the characteristics of one or more of the other barriers 1230. Each barrier 1230 forms a fluidic seal with the adjacent wall 1224 of the LCA 1220 (which may include the wall 1226 of the receptacle 1225).

Below the lowest barrier 1230-X, there is a continuous cavity 1229 throughout the remainder of the LCA 1220. The remainder of the LCA 1220 below the receptacle 1225 may be or include a tubing string, which is made up of multiple tubing pipes that are coupled directly or indirectly to each other end to end in series (e.g., substantially similar to the tubing string 1255 of the UCA 1250). Most of the tubing string of the LCA 1220 may be positioned within the wellbore (e.g., wellbore 111) in the subterranean formation (e.g., subterranean formation 110). In this case, the cavity 1229 above the lowest barrier 1230-X is filled with working fluid 1282. There is no working fluid 1282 above the highest barrier 1230-1. There may be, or may not be, working fluid 1282 between intermediate barriers 1230 disposed in the cavity 1229.

Each barrier 1230 of the LCA 1220 is not designed to be permanent. Specifically, each barrier 1230 is designed to open (e.g., break) the fluidic seal with the wall 1224 of the LCA 1220 (which may include the wall 1226 of the receptacle 1225) under certain conditions. In some cases, a barrier 1230 may be configured in such a way that allows a user 175 to set the conditions under which the barrier 1230 opens (e.g., breaks) the fluidic seal with the wall 1224 of the LCA 1220 (which may include the wall 1226 of the receptacle 1225). In other cases, the conditions under which a barrier 1230 opens (e.g., breaks) the fluidic seal with the wall 1224 of the LCA 1220 (which may include the wall 1226 of the receptacle 1225) are set by the manufacturer of the barrier 1230. In certain example embodiments, the threshold value of the differential force of a barrier 1230 is less than the threshold value of the differential force of the next-lowest barrier 1230 (if any) and is greater than the threshold value of the differential force of the next-highest barrier 1230 (if any).

Each barrier 1230 may be positioned at any point within the cavity 1227 of the receptacle 1225 and/or the cavity 1229 of the LCA 1220. In some cases, when a barrier 1230 opens (e.g., breaks) the fluidic seal with the wall 1224 of the LCA 1220 (which may include the wall 1226 of the receptacle 1225), the barrier 1230 may break apart into a number of small pieces that are not retrievable. A barrier 1230 may take one or more of a number of forms. For example, a barrier 1230 may be or include a disc (e.g., made of glass, made of ceramics). As another example, a barrier 1230 may be or include a valve (e.g., a multi-stage ball valve).

The UCA 1250 of the subsea completion system 1240 in this case includes a tubing string 1255 that is or includes multiple tubing pipes that are coupled directly or indirectly to each other end to end in series. Some of the tubing string 1255 may be disposed below the lowest-most barrier 1330-1 at the bottom end of the UCA 1250, while the remainder (the majority) of the tubing string 1255 is disposed above the lowest-most barrier 1330-1. The tubing string 1255 has a tubing string wall 1254 that forms a tubing string cavity 1257 that runs along all or most of the height of the tubing string 1255. The diameter of the tubing string wall 1254 may be smaller than the diameter formed by the receptacle wall 1226 of the receptacle 1225 of the LCA 1220. The cavity 1257 may originate at or near a floating platform (e.g., floating structure 103) and continues downward to the upper-most barrier 1330-Y. Most of the tubing string 1255 of the UCA 1250 may be positioned inside a riser (e.g., riser 116). The UCA 1250 also includes a tubing hanger 1266.

In this example, there may be multiple barriers 1330 integrated with the UCA 1250. Specifically, there are Y barriers 1330 (barrier 1330-1 through barrier 1330-Y) within the cavity 1257 of the tubing string 1255 of the UCA 1250. The barriers 1330 are aligned in series with each other. Adjacent barriers 1330 are separated from each other by a distance within the cavity 1257 of the tubing string 1255 of the UCA 1250. The characteristics (e.g., thickness, material, configurability, configuration, differential force threshold value) of one barrier 1330 may be the same as, or different than, the characteristics of one or more of the other barriers 1330. Each barrier 1330 forms a fluidic seal with the adjacent wall 1254 of the UCA 1250. Above the highest barrier 1330-Y, there is a continuous cavity 1257 throughout the remainder of the tubing string 1255 (which may also include a riser (e.g., riser 116)) of the UCA 1250. In this case, the cavity 1257 above the highest barrier 1330-Y is filled with working fluid 1282. There is no working fluid 1282 below the lowest barrier 1330-1. There may be, or may not be, working fluid 1282 between intermediate barriers 1330 disposed in the cavity 1257.

Each barrier 1330 of the UCA 1250 is not designed to be permanent. Specifically, each barrier 1330 is designed to open (e.g., break) the fluidic seal with the wall 1254 of the UCA 1250 under certain conditions. In some cases, a barrier 1330 may be configured in such a way that allows a user (e.g., user 175) to set the conditions under which the barrier 1330 opens (e.g., breaks) the fluidic seal with the wall 1254 of the UCA 1250. In other cases, the conditions under which a barrier 1330 opens (e.g., breaks) the fluidic seal with the wall 1254 of the UCA 1250 are set by the manufacturer of the barrier 1330. Each barrier 1330 may be positioned at any point within the cavity 1257 of the UCA 1250. In some cases, when a barrier 1330 opens (e.g., breaks) the fluidic seal with the wall 1254 of the UCA 1250, the barrier 1330 may break apart into a number of small pieces that are not retrievable. A barrier 1330 may take one or more of a number of forms. For example, a barrier 1330 may be or include a disc (e.g., made of glass, made of ceramics). As another example, a barrier 1330 may be or include a valve (e.g., a multi-stage ball valve).

Also positioned within the casing string 1215 in FIG. 12 is a production packer 1259, which is generally a short hollow cylinder. The production packer 1259 abuts against the inner surface of the wall of the casing string 1215 along its outer perimeter, and the production packer 1259 abuts against the outer surface of the LCA wall 1224 along its inner perimeter. Under this configuration, the production packer 1259 creates a fluidic seal with the wall 1224 of the LCA 1220 and with the casing string 1215. As a result, the packer fluid 1283 remains above the production packer 1259 within the casing string 1215, and none of the packer fluid 1283 is below the production packer 1259 within the casing string 1215.

Figure 13:
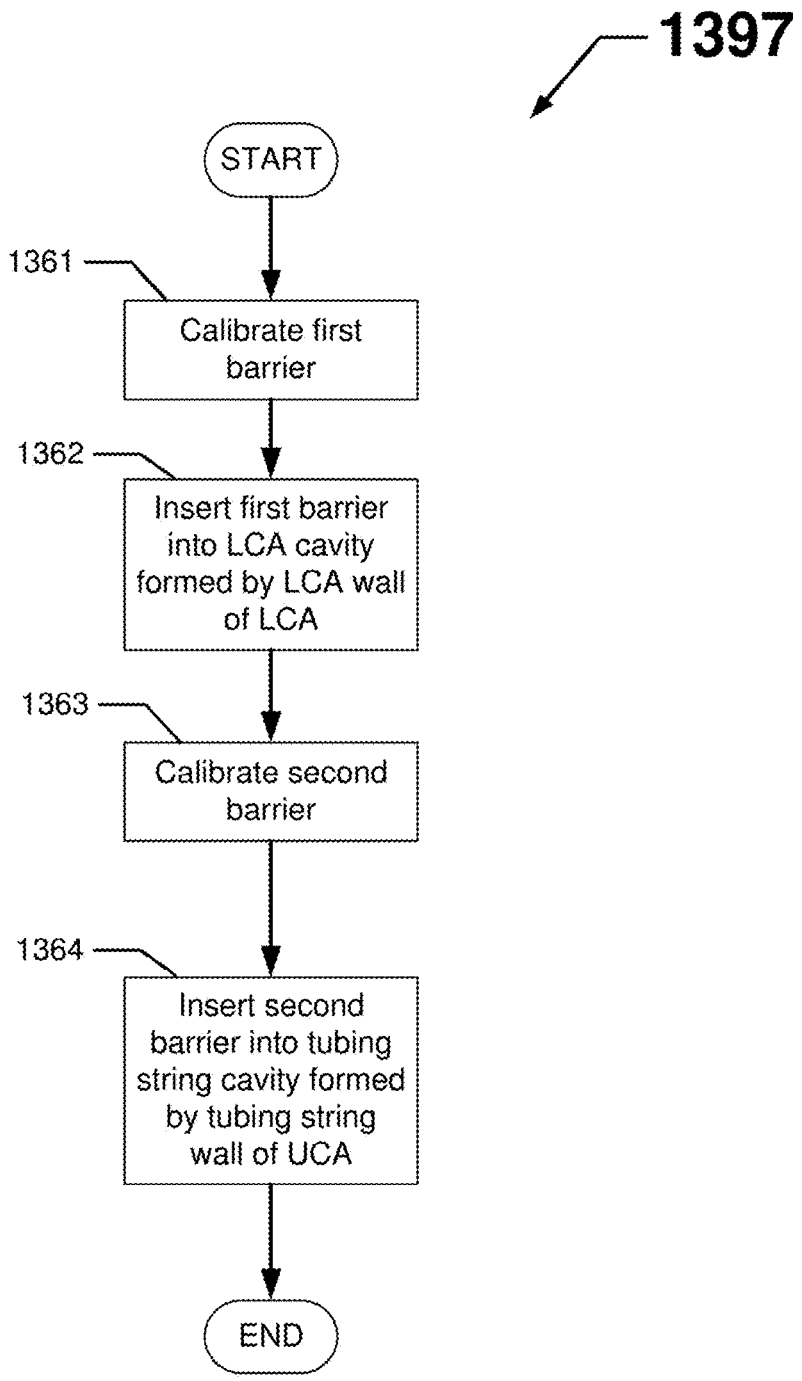
FIG. 13 shows a flowchart for a method of establishing a subsea completion system according to certain example embodiments.

FIG. 13 shows a flowchart 1397 for a method of establishing a subsea completion system according to certain example embodiments. While the various steps in this flowchart 1397 are presented sequentially, one of ordinary skill will appreciate that some or all of the steps may be executed in different orders, may be combined or omitted, and some or all of the steps may be executed in parallel. Further, in one or more of the example embodiments, one or more of the steps shown in this example method may be omitted, repeated, and/or performed in a different order. Some or all of the steps of the method of FIG. 13 can be performed off site (e.g., at a manufacturing facility, at a staging area). In addition, or in the alternative, some or all of the steps of the method of FIG. 13 can be performed on site (e.g., in the field, on a floating structure 103) where a field operation is being performed or planned.

In addition, a person of ordinary skill in the art will appreciate that additional steps not shown in FIG. 13 may be included in performing this method. Accordingly, the specific arrangement of steps should not be construed as limiting the scope. Further, a particular computing device, such as a controller 104 discussed above with respect to FIG. 1, can be used to perform one or more of the steps (or portions thereof) for the method shown in FIG. 13 in certain example embodiments. Any of the functions performed below by a controller 104 can involve the use of one or more protocols, one or more algorithms, and/or stored data stored in a storage repository. In addition, or in the alternative, any of the functions in the method can be performed by a user (e.g., user 175), which may include an associated user system (e.g., user system 176).

The method shown in FIG. 13 is merely an example that can be performed by using an example system described herein. In other words, systems for establishing a subsea completion system 140 can perform other functions using other methods in addition to and/or aside from those shown in FIG. 13. Referring to the description above with respect to FIGS. 1 through 12, but using reference numbers from FIGS. 1 and 2 by way of example in this case, the method shown in the flowchart 1397 of FIG. 13 begins at the START step and proceeds to step 1361, where a first barrier 230-1 is calibrated. The first barrier 230-1 may be calibrated to open (e.g., break) at approximately a threshold value. The threshold value may correspond to an amount of a differential force applied to the first barrier 230-1. When the first barrier 230-1 opens (e.g., breaks), a fluidic seal formed by the first barrier 230-1 is opened (e.g., broken). The first barrier 230-1 may be calibrated by a user 175 (e.g., in the field, at an offsite facility). Calibrating the first barrier 230-1 may involve whatever actions (e.g., insertion of retention pins, rotating a dial) are required based on the configuration of the first barrier 230-1. In some cases, the first barrier 230-1 is calibrated at the factory, and this calibration setting may not subsequently be changed. In such cases, this step 1361 may be optional.

In step 1362, the first barrier 230-1 is inserted within a top end of a lower completion assembly (LCA) cavity 229 formed by a LCA wall 224 of the LCA 220. The first barrier 230-1 may form a fluidic seal with the LCA wall 224. The first barrier 230-1 may be configured (e.g., based on construction, based on a factory setting, based on the calibration in step 1361) to open (e.g., break) when the first barrier 230-1 has a differential force with a threshold value applied to it within the LCA cavity 229. The LCA 220 with the first barrier 230-1 may be configured to be subsequently inserted into the casing string 115. In some cases, as when the first barrier 230-1 is a sub as shown and described in FIG. 7 above (e.g., including a glass disc 735, a sliding sleeve 733, one or more shear pins 734 used to hold the sliding sleeve 733 in place), inserting the first barrier 230-1 may include inverting a standard orientation of the sub. Alternatively, the first barrier 230-1 may be installed in a standard orientation.

In step 1363, a second barrier 230-2 is calibrated. The second barrier 230-2 may be calibrated to open (e.g., break) at approximately a threshold value. The threshold value may correspond to an amount of a differential force applied to the second barrier 230-2. When the second barrier 230-2 opens (e.g., breaks), a fluidic seal formed by the second barrier 230-2 is opened (broken). The characteristics (e.g., thickness, material, configurability, configuration, differential force threshold value) of the second barrier 230-2 may be the same as, or different than, the characteristics of the first barrier 230-1.

The second barrier 230-2 may be calibrated by a user 175 (e.g., in the field, at an offsite facility). Calibrating the second barrier 230-2 may involve whatever actions (e.g., insertion of retention pins, rotating a dial) are required based on the configuration of the second barrier 230-2. The threshold value to which the second barrier 230-2 is calibrated may be different than the threshold value to which the first barrier 230-1 is calibrated in certain example embodiments. In some cases, the second barrier 230-2 is calibrated at the factory, and this calibration setting may not subsequently be changed. In such cases, this step 1363 may be optional.

In step 1364, the second barrier 230-2 is inserted within a bottom end of an upper completion assembly (UCA) cavity 257 formed by a tubing string wall 254 of a tubing string 255 of the UCA 250. The second barrier 230-2 may form a fluidic seal with the tubing string wall 254 of the UCA 250. The second barrier 230-2 may be configured (e.g., based on construction, based on a factory setting, based on the calibration in step 1363) to open (e.g., break) when the second barrier 230-2 has a differential force with a threshold value applied to it within the UCA cavity 257. The UCA 250 with the second barrier 230-2 may be configured to be subsequently inserted into the casing string 115.

In some cases, as when the second barrier 230-2 is a sub as shown and described in FIG. 7 above (e.g., including a glass disc 735, a sliding sleeve 733, one or more shear pins 734 used to hold the sliding sleeve 733 in place), inserting the second barrier 230-2 may include inverting a standard orientation of the sub. Alternatively, the second barrier 230-2 may be installed in a standard orientation. When step 1364 is complete, the subsea completion system 140 is established, and the process proceeds to the END step.

Figure 14:
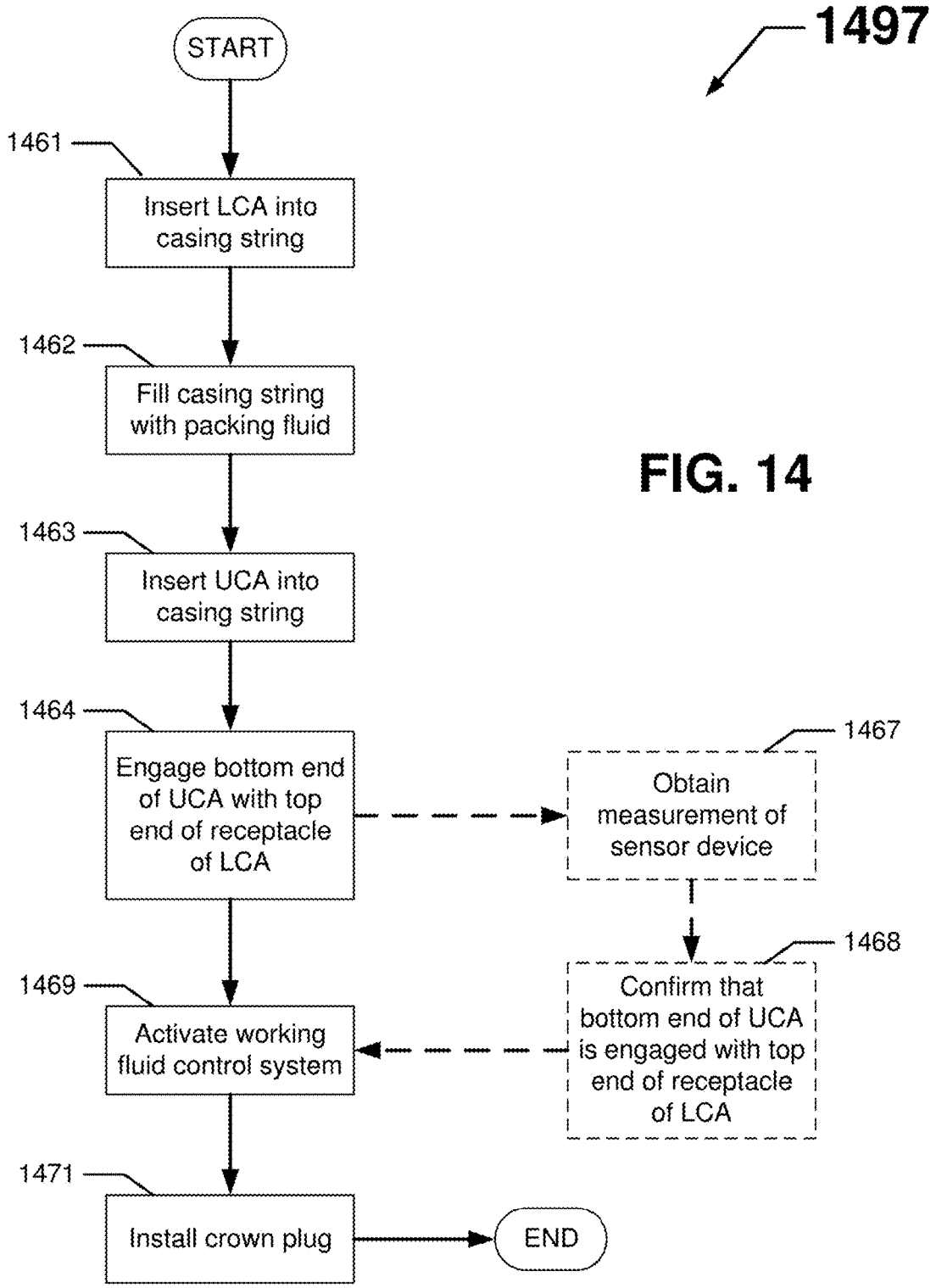
FIG. 14 shows a flowchart for a method of implementing a subsea completion system according to certain example embodiments.

FIG. 14 shows a flowchart 1497 for a method of implementing a subsea completion system according to certain example embodiments. While the various steps in this flowchart 1497 are presented sequentially, one of ordinary skill will appreciate that some or all of the steps may be executed in different orders, may be combined or omitted, and some or all of the steps may be executed in parallel. Further, in one or more of the example embodiments, one or more of the steps shown in this example method may be omitted, repeated, and/or performed in a different order. Some or all of the steps of the method of FIG. 14 can be performed off site (e.g., at a manufacturing facility, at a staging area). In addition, or in the alternative, some or all of the steps of the method of FIG. 14 can be performed on site (e.g., in the field, on a floating structure 103) where a field operation is being performed or planned.

In addition, a person of ordinary skill in the art will appreciate that additional steps not shown in FIG. 14 may be included in performing this method. Accordingly, the specific arrangement of steps should not be construed as limiting the scope. Further, a particular computing device, such as a controller 104 discussed above with respect to FIG. 1, can be used to perform one or more of the steps (or portions thereof) for the method shown in FIG. 14 in certain example embodiments. Any of the functions performed below by a controller 104 can involve the use of one or more protocols, one or more algorithms, and/or stored data stored in a storage repository. In addition, or in the alternative, any of the functions in the method can be performed by a user (e.g., user 175), which may include an associated user system (e.g., user system 176).

The method shown in FIG. 14 is merely an example that can be performed by using an example system described herein. In other words, systems for implementing a subsea completion system 140 can perform other functions using other methods in addition to and/or aside from those shown in FIG. 14. Referring to the description above with respect to FIGS. 1 through 13, but using reference numbers from FIGS. 1 and 2 by way of example in this case, the method shown in the flowchart 1497 of FIG. 14 begins at the START step and proceeds to step 1461, where a LCA 220 is inserted into a casing string 115 for a subsea wellbore 111. The LCA 220 may include a receptacle 225 disposed toward its top end. The LCA 220 may include a LCA wall 224 that forms a LCA cavity 229. The receptacle 225 may include a receptacle wall 226 that form a receptacle cavity 227.

The LCA cavity 229 (which may include the receptacle cavity 227) may have disposed therein toward its top end a first barrier 230-1 (e.g., as a result of performing step 1362 of FIG. 13 above). The first barrier 230-1 may form a first substantial fluidic seal with the LCA wall 224 (which may include the receptacle wall 226). The first barrier 230-1 may be configured to open (e.g., break) the first substantial fluidic seal when a first differential force applied to the first barrier 230-1 within the LCA cavity 229 (which may include part of the receptacle cavity 227) reaches a first threshold value. The LCA cavity 229 (which may include part of the receptacle cavity 227) below the first barrier 230-1 may be filled with a working fluid 282 using, for example, the working fluid control system 170. The LCA 220 may be inserted into the casing string 115 using the driving system 180.

In step 1462, the casing string 115 is filled with packer fluid 283. The casing string may include a production packer 259 that limits the depth within the casing string 115 that the packer fluid 283 may fill. The packer fluid 283 may cover the top part of the LCA 220 in the casing string 115, but the first barrier 230-1 keeps the packer fluid 283 from flowing into the LCA cavity 229. The packer fluid 283 may be injected into the casing string 115 using a system that is equivalent to the working fluid control system 170, but directed to use with the packer fluid 283.

In step 1463, the UCA 250 is inserted into the casing string 115. The UCA 250 may include a tubing string 255 having a tubing string wall 254 that forms a tubing string cavity 257. The tubing string cavity 257 may have disposed therein toward its bottom end a second barrier 230-2 (e.g., as a result of performing step 1364 of FIG. 13 above). The second barrier 230-2 may form a second substantial fluidic seal with the tubing string wall 254. The second barrier 230-2 may be configured to open (e.g., break) the second substantial fluidic seal when a second differential force applied to the second barrier 230-2 within the tubing string cavity 257 reaches a second threshold value. The tubing string cavity 257 of the UCA 250 above the second barrier 230-2 may be filled with the working fluid 282 using, for example, the working fluid control system 170. The UCA 250 may be inserted into the casing string 115 using the driving system 180.

In step 1464, the bottom end of the UCA 250 is engaged with the top end of the receptacle 225 of the LCA 220. The bottom end of the UCA 250 may become engaged with the top end of the receptacle 225 of the LCA 220 using the driving system 180. Specifically, the driving system 180 may lower the UCA 250 within the casing string 115 until the bottom end of the UCA 250 enters the receptacle cavity 227 of the receptacle 225 of the LCA 220.

In certain example embodiments, engaging the bottom end of the tubing string 255 with the top end of the receptacle 225 raises the second differential force beyond the second threshold value, resulting in opening (e.g., breaking) the second barrier 230-2. In other example embodiments, engaging the bottom end of the tubing string 115 with the top end of the receptacle 225 runs the bottom end of the tubing string 255 into the first barrier 230-1 at a first differential force that exceeds the first threshold value, resulting in opening (e.g., breaking) the first barrier 230-1. In some cases, the bottom end of the tubing string 255 engages the top end of the receptacle 225 when a tubing hanger 266 of the UCA 250 is positioned within a seat of a Xmas tree 177. In such cases, the Xmas tree 177 may be a horizontal tree.

In optional step 1467, a measurement from a sensor device 160 may be obtained. For example, sensor device 160-1 and/or sensor device 160-2 may be used to measure a parameter (e.g., a magnetic field, proximity) associated with the bottom part of the UCA 250 engaging the receptacle 225 of the LCA 220. The measurement may be obtained by a user 175. In addition, or in the alternative, the measurement may be obtained by a controller 104. In optional step 1468, The bottom end of the UCA 250 is confirmed to be engaged with the receptacle of the LCA based on the measurement. The confirmation may be made by a user 175. In addition, or in the alternative, the confirmation may be made by a controller 104.

In step 1469, the working fluid control system 170 may be activated. The working fluid control system 170 may be activated by a user 175. In addition, or in the alternative, the working fluid control system 170 may be activated by a controller 104. In some cases, activating the working fluid control system may include pumping the working fluid 282 at a progressively higher rate into the tubing string cavity 257. As a result, a differential force applied to the second barrier 230-2 and/or the first barrier 230-1 may be sufficiently high to exceed the applicable threshold value needed to open (e.g., break) that barrier 230.

In certain example embodiments, activating the working fluid control system 170 raises the first differential force applied to the first barrier 230-1 until the first differential force exceeds the first threshold value, resulting in the first barrier 230-1 opening (e.g., breaking). In other example embodiments, activating the working fluid control system 170 raises the second differential force applied to the second barrier 230-2 until the second differential force exceeds the second threshold value, resulting in the second barrier 230-2 opening (e.g., breaking).

In step 1471, a crown plug (e.g., crown plug 356, crown plug 856) is installed. The one or more crown plugs may be installed on a Xmas tree 177. The one or more crown plugs may be installed after the tubing hanger 266 is stabbed into the Xmas tree 177. The crown plug may be installed using equipment controlled from a floating structure 103. When step 1471 is complete, the process may proceed to the END step.

In some cases, when example embodiments are directed to a method of establishing a subsea completion system, the method may include inserting a first barrier within a top end of a LCA cavity formed by a LCA wall of the LCA, where first barrier forms a first fluidic seal with the LCA wall, where the first barrier is configured to open the first fluidic seal when a first differential force applied to the first barrier within the LCA cavity reaches a first threshold value, and where the LCA with the first barrier is configured to be subsequently inserted into a casing string. Such a method may also include inserting a second barrier toward a bottom end of a tubing string of a UCA, where the tubing string has a tubing string cavity formed by a tubing string wall, where the second barrier forms a second fluidic seal with the tubing string wall, where the second barrier is configured to open the second fluidic seal when a second differential force applied to the second barrier within the tubing string cavity reaches a second threshold value, and where the UCA with the second barrier is configured to be inserted into the casing string after the LCA is inserted into the casing string.

In such cases, the method of establishing a subsea completion system may further include calibrating the first barrier to open the first fluidic seal at approximately the first threshold value, and calibrating the second barrier to open the second fluidic seal at approximately the second threshold value. In such cases, inserting the second barrier may include inverting a standard orientation of the second barrier when the second barrier comprises a sub, where the sub comprises a glass disc, a sliding sleeve, and a shear pin used to hold the sliding sleeve in place.

In some cases, when example embodiments are directed to a method of implementing a subsea completion system, the method may include inserting a LCA into a casing string for a subsea wellbore, where the LCA includes a receptacle disposed toward its top end and has a LCA wall that forms a LCA cavity, where the LCA cavity has disposed therein toward its top end a first barrier, where first barrier forms a first substantial fluidic seal with the LCA wall, where the first barrier is configured to open the first substantial fluidic seal when a first differential force applied to the first barrier within the LCA cavity reaches a first threshold value, and where the LCA below the first barrier is filled with a working fluid. Such a method may also include filling the casing string with a packer fluid, and inserting a UCA into the casing string, wherein the UCA includes a tubing string having a tubing string wall that forms a tubing string cavity, where the tubing string cavity has disposed therein toward its bottom end a second barrier, where the second barrier forms a second substantial fluidic seal with the tubing string wall, where the second barrier is configured to open the second substantial fluidic seal when a second differential force applied to the second barrier within the tubing string cavity reaches a second threshold value, and where the UCA above the second barrier is filled with the working fluid. Such a method may further include engaging the bottom end of the UCA with the top end of the receptacle of the LCA, activating a working fluid control system, and installing a crown plug.

In such cases, the method of implementing a subsea completion system may also include, prior to activating the working fluid control system to raise the first differential force applied to the first barrier, obtaining a measurement from a sensor device positioned proximate to the bottom end of the UCA, and confirming, based on the measurement, that the bottom end of the UCA is engaged with the receptacle of the LCA. In addition, or in the alternative, in such cases, activating the working fluid control system may include pumping the working fluid at a progressively higher rate into the tubing string cavity. In addition, or in the alternative, in such cases, engaging the bottom end of the tubing string with the top end of the receptacle may raise the second differential force beyond the second threshold value. In addition, or in the alternative, in such cases, activating the working fluid control system may raise the first differential force applied to the first barrier until the first differential force exceeds the first threshold value.

In addition, or in the alternative, in such cases, engaging the bottom end of the tubing string with the top end of the receptacle may run the bottom end of the tubing string into the first barrier at a first differential force that exceeds the first threshold value. In addition, or in the alternative, in such cases, activating the working fluid control system may raise the second differential force applied to the second barrier until the second differential force exceeds the second threshold value. In addition, or in the alternative, in such cases, the bottom end of the tubing string may engage the top end of the receptacle when a tubing hanger of the UCA is positioned within a seat of a Xmas tree. In addition, or in the alternative, in such cases, the Xmas tree may be a horizontal Xmas tree.

Example embodiments can be used to safely and reliably install crown plugs in the tubing hanger. Example embodiments can use multiple barriers to isolate parts of a completion assembly so that little or no packer fluid is introduced to the subterranean formation. Example embodiments can be used for any of a number of field operations at various pressures, flow rates, and temperatures. Example embodiments can provide a number of benefits. Such benefits can include, but are not limited to, ease of use, reduction in costs, improved safety and reliability, reduced need of specialized equipment, configurability, time savings, and compliance with applicable industry standards and regulations.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A subsea completion system comprising:

a lower completion assembly (LCA) comprising a receptacle disposed at a top end of the LCA, wherein the LCA comprises a LCA wall that forms a LCA cavity;

a first barrier disposed within the LCA cavity, wherein the first barrier forms a first fluidic seal with the LCA wall, and wherein the first barrier is configured to open the first fluidic seal when a first differential force applied to the first barrier within the LCA cavity reaches a first threshold value;

an upper completion assembly (UCA) comprising a tubing string disposed toward a bottom end of the UCA, wherein the tubing string comprises a tubing string wall that forms a tubing string cavity, and wherein the receptacle of the LCA is configured to receive the tubing string at the bottom end of the UCA when a tubing hanger that is integrated with the tubing string is seated within an Xmas tree uphole of the LCA; and a second barrier disposed within the tubing string cavity, wherein the second barrier forms a second fluidic seal with the tubing string wall, and wherein the second barrier is configured to open the second fluidic seal when a second differential force applied to the second barrier within the tubing string cavity reaches a second threshold value.

2. The subsea completion system of claim 1, wherein the receptacle comprises a polished bore receptacle.

3. The subsea completion system of claim 1, wherein the LCA wall has a first diameter that is larger than a second diameter of the tubing string wall.

4. The subsea completion system of claim 1, wherein the second barrier comprises a glass disc.

5. The subsea completion system of claim 4, wherein the glass disc is part of a sub integrated with the tubing string.

6. The subsea completion system of claim 5, wherein the sub further comprises a shear pin that is configured to shear when the second differential force applied to the second barrier within the tubing string reaches the second threshold value.

7. The subsea completion system of claim 6, wherein the sub further comprises a piercing device that is configured to break the glass disc of the second barrier when the glass disc is forced upon the piercing device after the shear pin shears.

8. The subsea completion system of claim 6, wherein the sub further comprises a sliding sleeve configured to be held in place by the shear pin, wherein the sliding sleeve is configured to slide after the shear pin shears and allows the glass disc to move, wherein the glass disc is configured to break when glass disc moves into the piercing device, and wherein the second differential force reaches the second threshold value when the bottom end of the tubing string of the UCA is stabbed into the top end of the receptacle of the LCA.

9. The subsea completion system of claim 1, further comprising:

a third barrier disposed within the LCA cavity, wherein the third barrier forms a third fluidic seal with the LCA wall, wherein the third barrier is configured to open the third fluidic seal when a third differential force applied to the third barrier within the LCA cavity reaches a third threshold value, and wherein the third barrier is positioned below the first barrier.

10. The subsea completion system of claim 1, wherein the first barrier comprises a ball valve.

11. The subsea completion system of claim 1, wherein the second threshold value is less than the first threshold value.

12. The subsea completion system of claim 1, wherein the UCA and the LCA are disposed within a casing string.

13. The subsea completion system of claim 12, wherein the first barrier prevents a packer fluid that is injected inside the casing string after the LCA is inserted into the casing string from entering the LCA cavity when the first barrier forms the first fluidic seal with the LCA wall, and wherein the second barrier of the UCA, inserted inside the casing string after the packer fluid is injected inside the casing string, prevents the packer fluid disposed between the UCA and the casing string from entering the tubing string cavity when the second barrier forms the second fluidic seal with the tubing string wall.

14. The subsea completion system of claim 12, wherein the first barrier seals a working fluid within the LCA cavity below the first barrier when the first barrier forms the first fluidic seal with the LCA wall, and wherein the second barrier seals the working fluid within the tubing string cavity above the second barrier when the second barrier forms the second fluidic seal with the tubing string wall.

15. The subsea completion system of claim 14, further comprising:

a working fluid control system that is configured to control a flow of the working fluid into the UCA from a top end of the UCA, wherein the working fluid control system is further configured to raise the pressure through the working fluid within the tubing string cavity beyond the first threshold value, after the second barrier opens the second fluidic seal with the tubing string wall, to cause the first barrier to open the first fluidic seal with the LCA wall.

16. The subsea completion system of claim 12, further comprising:

a driving system that is configured to move the UCA within the casing string, wherein the driving system is further configured to lower the bottom end of the tubing string of the UCA into the top end of the receptacle of the LCA.

17. The subsea completion system of claim 16, wherein the driving system is further configured to lower the LCA into place within the casing string prior to lowering the UCA toward the LCA within the casing string.

18. The subsea completion system of claim 16, further comprising:

a sensor device that is configured to provide an indication when the bottom end of the tubing string of the UCA is stabbed into the top end of the receptacle of the LCA, wherein the indication triggers a working fluid control system to raise the pressure through a working fluid within the tubing string cavity so that the first differential force imposed on the first barrier exceeds the first threshold value.

19. A method of establishing a subsea completion system, the method comprising:

inserting a first barrier within a top end of a lower completion assembly (LCA) cavity formed by a LCA wall of the LCA, wherein first barrier forms a first fluidic seal with the LCA wall, wherein the first barrier is configured to open the first fluidic seal when a first differential force applied to the first barrier within the LCA cavity reaches a first threshold value, and wherein the LCA with the first barrier is configured to be subsequently inserted into a casing string; and inserting a second barrier toward a bottom end of a tubing string of an upper completion assembly (UCA), wherein the tubing string has a tubing string cavity formed by a tubing string wall, wherein the second barrier forms a second fluidic seal with the tubing string wall, wherein the second barrier is configured to open the second fluidic seal when a second differential force applied to the second barrier within the tubing string cavity reaches a second threshold value, and wherein the UCA with the second barrier is configured to be inserted into the casing string after the LCA is inserted into the casing string.

20. A method of implementing a subsea completion system, the method comprising:

inserting a lower completion assembly (LCA) into a casing string for a subsea wellbore, wherein the LCA comprises a receptacle disposed toward its top end and has a LCA wall that forms a LCA cavity, wherein the LCA cavity has disposed therein toward its top end a first barrier, wherein first barrier forms a first substantial fluidic seal with the LCA wall, wherein the first barrier is configured to open the first substantial fluidic seal when a first differential force applied to the first barrier within the LCA cavity reaches a first threshold value, and wherein the LCA below the first barrier is filled with a working fluid;

filling, after inserting the LCA into the cavity, the casing string with a packer fluid, wherein the first barrier prevents the packer fluid from entering the LCA cavity;

inserting an upper completion assembly (UCA) into the casing string, wherein the UCA comprises a tubing string having a tubing string wall that forms a tubing string cavity, wherein the tubing string comprises a tubing hanger having a crown plug located above the UCA, wherein the tubing string cavity has disposed therein toward its bottom end a second barrier, wherein the second barrier forms a second substantial fluidic seal with the tubing string wall, wherein the second barrier is configured to open the second substantial fluidic seal when a second differential force applied to the second barrier within the tubing string cavity reaches a second threshold value, and wherein the UCA above the second barrier is filled with the working fluid;

engaging the bottom end of the UCA with the top end of the receptacle of the LCA; and activating a working fluid control system.

* * * * *